US007589320B2

(12) United States Patent
Baba et al.

(10) Patent No.: US 7,589,320 B2
(45) Date of Patent: Sep. 15, 2009

(54) MASS SPECTROMETER

(75) Inventors: Takashi Baba, Kawagoe (JP); Hiroyuki Satake, Kokubunji (JP); Izumi Waki, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 135 days.

(21) Appl. No.: 11/979,219

(22) Filed: Oct. 31, 2007

(65) Prior Publication Data

US 2008/0078930 A1 Apr. 3, 2008

Related U.S. Application Data

(63) Continuation of application No. 11/338,844, filed on Jan. 25, 2006, now Pat. No. 7,309,860.

(30) Foreign Application Priority Data

Jan. 28, 2005 (JP) ..... 2005-020543
Jun. 1, 2005 (JP) ..... 2005-160861

(51) Int. Cl.
*H01J 49/00* (2006.01)

(52) U.S. Cl. ..... 250/290; 250/281; 250/282

(58) Field of Classification Search ..... 250/290, 250/292, 281, 282
See application file for complete search history.

(56) References Cited

U.S. PATENT DOCUMENTS 5,536,944 A 7/1996 Tsunoda et al.
6,653,622 B2 11/2003 Franzen
6,800,851 B1 10/2004 Zubarev et al.
6,803,569 B2 * 10/2004 Tsybin et al. ..... 250/292
6,987,261 B2 1/2006 Horning et al.
6,995,366 B2 2/2006 Franzen
7,060,987 B2 6/2006 Lee et al.
7,129,478 B2 10/2006 Baba et al.
7,166,835 B2 * 1/2007 Baba et al. ..... 250/281
2004/0232324 A1 11/2004 Berkout et al.
2004/0245448 A1 12/2004 Glish et al.

FOREIGN PATENT DOCUMENTS

JP 3361528 7/1995

(Continued)

OTHER PUBLICATIONS

Frank Kjeldsen et al., "Dissociative Capture of Hot (3-13 eV) Electrons by Polypeptide Polycations: An Efficient Process Accompanied by Secondary Fragmentation", Chemical Physical Letters, Apr. 22, 2002, pp. 201-206.

(Continued)

*Primary Examiner*—Kiet T Nguyen
(74) *Attorney, Agent, or Firm*—Stites & Harbison, PLLC; Juan Carlos A. Marquez, Esq.

(57) ABSTRACT

An electron capture dissociation device to implement a combination of electron capture dissociation and collision dissociation and a mass spectrometer with the use thereof are provided. This device includes a linear ion trap provided with linear multipole electrodes applied with a radio frequency electric field and wall electrodes that are arranged on both ends in the axis direction of the linear multipole electrodes, have holes on the central axis thereof, and generate a wall electric field by being applied with a direct-current voltage, a cylindrical magnetic field-generating unit that generates a magnetic field parallel to the central axis of the linear multipole electrodes and surrounds the linear ion trap, and an electron source arranged opposite to the linear multipole electrodes with sandwiching one of the wall electrodes. The electron generation site of the electron source is placed in the inside of the magnetic field generated by the magnetic field-generating unit.

15 Claims, 32 Drawing Sheets

FOREIGN PATENT DOCUMENTS

| | | |
|---|---|---|
| JP | 10-21871 | 7/1996 |
| WO | WO 02/078048 A1 | 3/2002 |

OTHER PUBLICATIONS

Oleg A. Silivra et al., "Electron Capture Dissociation of Polypeptides in a Three-Dimensional Quadrupole Ion Trap: Implementation and First Results", American Society for Mass Spectrometry, vol. 16 (2005), pp. 22-27.

Takashi Baba et al., "Electron Capture Dissociation in a Radio Frequency on Trap", Analytical Chemistry 2004, vol. 76, No. 15, pp. 4263-4266.

Jae C. Schwartz et al., "A Two-Dimensional Quadrupole Ion Trap Mass Spectrometer", American Society for Mass Spectrometry, vol. 13 (2002), pp. 659-669.

* cited by examiner

MASS SPECTROMETER

CROSS REFERENCE TO RELATED APPLICATIONS

This application is a Continuation of nonprovisional U.S. application Ser. No. 11/338,844 filed on Jan. 25, 2006 now U.S. Pat. No. 7,309,860. Priority is claimed based on U.S. application Ser. No. 11/338,844 filed on Jan. 25, 2006, which claims the priority of Japanese application JP 2005-020543 filed on Jan. 28, 2005 and JP 2005-160861 filed on Jun. 1, 2005, all of which is incorporated by reference.

Claims priority from Japanese application JP 2005-020543 filed on Jan. 28, 2005 and JP 2005-160861 filed on Jun. 1, 2005, the contents of which are hereby incorporated by reference into this application.

FIELD OF THE INVENTION

The present invention relates to a method and an apparatus for analysis of sequence structure of large biomolecules with the use of mass spectrometry.

BACKGROUND OF THE INVENTION

After completion of the analysis of the human DNA sequence, currently the structural analysis of proteins synthesized from this genetic information as well as post-translationally modified molecules from these proteins has become increasingly important. As a method of the structural analysis, i.e. amino-acids sequence analysis, mass spectrometers are available. Particularly, mass spectrometers composed of ion traps and Q mass filters using a radio frequency (RF) electric field and time-of-flight (TOF) mass spectrometers are high speed analysis tools, and therefore, these have good compatibility with a preseparation device of sample, such as liquid chromatography apparatus. Accordingly, these are suitable for proteomics in which a large number of samples must be continuously analyzed.

In mass spectrometers, sample molecules are ionized and then injected into vacuum (or ionized in vacuum), and mass to charge ratios of target molecular ions are determined by movements of the ions in an electromagnetic field. Since the obtained information represents macroscopic quantities of mass to charge ratios, it is difficult to obtain information on internal structure, or sequence, by a single mass analysis. Accordingly, a method called tandem mass spectrometry is used. That is, sample ions are specified or selected in a first mass analysis. These ions are referred to as parent ions. Subsequently, the parent ions are dissociated by a certain technique. The dissociated ions are referred to as fragment ions. The dissociated ions are further mass analyzed, thereby obtaining some information on generation patterns of the fragment ions. Since there is a rule for dissociation patterns depending on each dissociation technique, it becomes possible to presume the sequence structure of the parent ions. Particularly, in the analysis of biomolecules composed of amino acids, collision induced dissociation (CID), infra red multi photon dissociation (IRMPD), and electron capture dissociation (ECD) are used for the dissociation technique.

CID is currently the most widely used in the protein analysis. Kinetic energy is provided to the parent ions to allow them to collide with gas. Molecular vibrational states are excited by the collision and the molecular chain is dissociated at sites susceptible to cleavage. Further, a method that has recently come to be used is IRMPD. The parent ions are irradiated by infra red laser to allow them to absorb multiple photons. The molecular vibrations are excited and a molecular chain is dissociated at a site susceptible to cleavage. The sites susceptible to cleavage by CID or IRMPD are sites designated as b-y in the backbone consisting of amino acid sequence. It is known that a complete structural analysis can not be carried out only by CID or IRMPD, since even when sites correspond to b-y, those are sometimes hard to be cleaved depending on the kind of amino acid sequence pattern. Therefore, a pretreatment using an enzyme or the like becomes necessary, which hampers high speed analysis. Further, when CID or IRMPD is used for biomolecules with post-translational modification, side chains involved in post-translational modification tend to be easily lost. Due to facile cleavage of the side chains, it is possible to judge molecular species involved in the modification based on lost mass and whether modified or not. However, important information on modification sites concerning which amino acids are modified is lost.

On the other hand, an alternative dissociation technique, ECD, is less dependent on amino acid sequence (as an exception, proline residue with a cyclic structure is not cleaved) and cleaves only one c-z site on the backbone of amino acid sequence. Therefore, a complete analysis of protein sequence can be performed only by mass analysis. In addition, ECD is suitable for research and analysis of post-translational modification owing to its property of hardly cleaving side chains. Therefore, this dissociation technique, ECD, attracts particular attention in recent years.

Electron energy for ECD is known to be approximately 1 eV (Non-patent Document 1). Further, an electron capture reaction is known to occur also near 10 eV. This reaction is referred to as hot ECD (HECD). The reaction that selectively cleaves the c-z site is the former ECD and the latter HECD generates a number of fragment ions cleaved at the c-z site as well as at other sites including the a-x site and b-y site. For this reason, ECD is preferred as a simple analysis technique. However, a combined use of HECD is also studied in a practical analysis. In other words, control of electron energy with accuracy below 1 eV is required to properly use ECD and HECD. As described above, CID and IRMPD and also ECD can be utilized in a mutually complementary manner to provide different sequence information.

Although ECD has been conventionally implemented only by Fourier transform ion cyclotron resonance (FT-ICR) mass spectrometer, a method in which ECD can be implemented in an RF ion trap has started to be reported. The advantage of utilizing the RF ion trap is its performance proven by wide industrial application based on the fact that its device is low in cost and its operation is simple compared with FT-ICR. Here, a conventional technique capable of ECD by FT-ICR, a conventional technique performed in an RF ion trap, and other techniques disclosed in patents are explained.

FIG. 19 is a schematic diagram to explain an example of a basic device structure of ECD by FT-ICR. It includes an ion introduction unit (1909 to 1911) and an FT-ICR unit (1901 to 1908). The ion introduction unit includes linear quadrupole electrodes (represented by the reference numeral 1909) and wall electrodes (1910 and 1911), an RF voltage is applied to the linear quadrupole electrodes, and a positive static voltage with respect to the linear quadrupole electrodes is applied to the wall electrodes, thereby capturing positive sample ions injected (the injection is indicated by an arrow 1912). Only ion species wanted to be measured is isolated from the sample ions in this ion introduction unit. The isolated ions are ejected from the ion introduction unit as shown by an arrow 1913 by applying a voltage lower than that of the linear quadrupole electrodes to the wall electrode 1910 and injected into the FT-ICR unit.

The FT-ICR unit includes a strong magnetic field (typically not weaker than 1 T; lines of magnetic force are indicated by arrows represented by 1908), four pick-up electrodes (1901 to 1904), and two pieces of wall electrodes (1905 and 1906). The isolated ions are captured by the magnetic field in the direction perpendicular to the magnetic field. Further, it is captured by a static voltage applied between the pick-up electrodes and the wall electrodes in the direction parallel to the magnetic field. Electrons generated by an electron source 1907 are injected into an FT-ICR cell and an ECD reaction is induced. Dissociated ions produced by the ECD reaction are measured for their masses by detecting electric currents induced in the pick-up electrodes by cyclotron frequency of the ions.

As described above, FT-ICR does not use a variable electromagnetic field such as RF but uses a static electromagnetic field in order to capture ions. Accordingly, electrons are not accelerated by the electromagnetic field. The use of the static electromagnetic field allows electrons to be led to the trapped ions at a low kinetic energy of 1 eV in a state that the ions are trapped. However, since FT-ICR requires a strong parallel magnetic field (higher than several teslas) with the use of a superconducting magnet, it is high in cost and large in size. Further, in order to obtain one spectrum, the measurement requires several seconds to ten seconds, and the time for the Fourier analysis necessary to obtain the spectrum is approximately ten seconds. It can not be said that FT-ICR that requires several tens of seconds in total has excellent compatibility with liquid chromatography in which one peak appears approximately in ten seconds. In other words, FT-ICR has a disadvantage or difficulty for use in high speed protein analysis. For this reason, the development of ECD technique that does not employ FT-ICR has been awaited.

As one technique for realization of ECD that does not employ FT-ICR, an idea in which an ECD reaction is allowed to occur by passing ions through electron cloud trapped in a Penning trap by a static electromagnetic field is disclosed (Patent Document 1). However, realization of ECD by this technique has not been reported to date.

As another technique for realization of ECD that does not employ FT-ICR, there is an idea in which ions are trapped in an RF ion trap or an RF ion guide and electrons are irradiated thereto. There are patent disclosures related to the idea in which electrons are irradiated to ions trapped in a three-dimensional RF ion trap (Patent Documents 2, 3, and 4). Prior to these disclosures, Vachet et al. tried to realize the reaction of electrons with ions by injecting an ion beam into a three dimensional RF ion trap (Non-patent Document 2); however, the incident electrons were heated by an RF electric field and lost to the outside of the ion trap, thus not giving rise to realization of ECD.

To avoid the problem of heating of electrons in an RF ion trap and an RF ion guide, an idea in which electron trajectories are restricted with the use of a magnetic field is disclosed. In the inside of an RF electric field, a condition to stably capture both ions and electrons can not be practically obtained. Hence, ideas to restrict movements of electrons in the direction perpendicular to lines of magnetic force with the use of a magnetic field have been devised.

One technique has been disclosed by Zubarev et al. (Patent Document 5), in which electron trajectories are restricted by applying a magnetic field to a three dimensional ion trap or an ion guide not having an ion trap function, thus avoiding heating of electrons. Its conceptual diagram is shown in FIG. 17. This includes a three dimensional ion trap (1701 to 1703), an electron source formed of a filament (1709), an ion source (1710), and an ion detector (1708). In the three dimensional ion trap, cylindrical permanent magnets (1704-1706) are embedded. A magnetic field parallel with the central axis is applied by these permanent magnets. First, ions produced by the ion source are trapped in the three dimensional ion trap. Here, parent ions to be measured are isolated from sample ions using resonance excitation of the ions. Electrons produced by the filament electron source are injected into the ion trap to cause an ECD reaction. Ions produced by the reaction are resonantly ejected and detected. Realization of the above ECD reaction by the three dimensional ion trap has been reported (Non-patent Document 3).

Another technique that has been proposed is that electron trajectories are restricted by applying a magnetic field to a linear ion trap in parallel with the central axis thereof and heating of electrons is avoided. Its conceptual diagram is shown in FIG. 18. An ECD reaction unit includes linear quadrupole electrodes (1801), a wall electrode consisting of permanent magnet (1802), another wall electrode (1803), an RF power source (1804), and an electron source unit (1809). The linear ion trap stores ions by means of a quadrupole electric field formed in the inside of the linear quadrupole electrodes by applying RF to the electrodes and a static electric field generated by applying a static voltage to the wall electrodes. Electrons are injected thereto. At this time, the electrons are injected along the central axis of RF. Since an RF electric field on the central axis is zero, the ions are not influenced by the RF electric field in the vicinity of the central axis or even when influenced, its effect is small. Further, a magnetic field generated by the permanent magnet 1802 is applied in parallel with the central axis. Thus, even when the electrons travel from the central axis, those are captured by the magnetic field, and thus their trajectories do not deviate from the central axis to a significant degree. In this way, heating of electrons are avoided. Since the present disclosure assumes that this ECD reaction unit is inserted between an ion source and another mass analysis unit represented by a TOF mass analysis unit, the electron source (1809) and an ion source (incidence of ions is shown by an arrow 1806) are combined by inserting a quadrupole deflector (1808) at one ion inlet of the linear ion trap. Ions produced by a reaction are ejected from the linear ion trap and then injected into said another mass analysis unit as shown by an arrow 1807 (Non-patent document 4).

[Patent Document 1] U.S. Patent No. 20040245448

[Patent Document 2] U.S. Pat. No. 6,653,622

[Patent Document 3] U.S. Patent No. 20040232324

[Patent Document 4] PCT/DK02/00195

[Patent Document 5] U.S. Pat. No. 6,800,851

[Patent Document 6] JP-A No. 021871/1998

[Patent Document 7] JP No. 03361528

[Non-patent Document 1] Frank Kjeldsen et al. Chem. Phys. Lett. 2002, vol. 1356, p2001-2006

[Non-patent Document 2] R. W. Vachet, S. D. Clark, G. L. Glish: Proceedings of the 43th ASMS conference on Mass Spectrometry and Allied Topics (1995) 1111

[Non-patent Document 3] Zubarev, R. A. et al. JASMS 2005, vol. 16, p22-27

[Non-patent Document 4] Takashi Baba et al. Analytical Chemistry 2004, vol. 76, p4263-4266

[Non-patent Document 5] Proceedings of the ASMS Conference on Mass Spectrometry 2003 (Th PL1 165)

[Non-patent Document 6] J. C. Schwartz et al. J. Am. Soc. Mass Spectom. 2002, vol. 13, p659

SUMMARY OF THE INVENTION

In the present invention, problems and means to solve the problems in electron capture dissociation (ECD) reaction using a linear ion trap are disclosed. The reason why a three-dimensional ion trap is not used but the linear ion trap is employed is that, in the three dimensional ion trap, the efficiency of electron injection into the ion trap at an energy usable for ECD is very low as disclosed in Patent Document 5 and Non-patent Document 4. In other words, only the electrons injected within a very short time in which ion trap radio frequency (RF) amplitude passes through near 0 V can exist in the trap at a low energy level. On the other hand, in the linear ion trap, there is no phase problem of the ion trap RF since electrons are injected along the central axis where RF voltage is not applied, thus the reaction efficiency is thought to be high in principle.

Although experimental research has been reported for the ECD reaction using an RF electric field and magnetic field, high speed acquisition of high quality spectra excellent in S/N that meets industrial application has not been realized with the use of either system that employs the three dimensional ion trap or the linear ion trap. According to current reports, in the three dimensional ion trap, signals excellent in S/N have not been obtained, and at most ECD fragment peak-like signals can be obtained after data processing to remove noises. Further, in the linear ion trap, a spectrum excellent in S/N is obtained after accumulating a number of spectra over ca. 30 sec to 600 sec. For a practical high-throughput protein analysis, it is desirable for a high quality spectrum to be obtainable in a time approximately equal to CID that provides information complementary to ECD, i.e. several tens to several hundred milliseconds. For high speed acquisition of spectra, there are two problems that are speed-up of the ECD reaction and enhancement of ion utilization efficiency.

For speed-up of the ECD reaction, it is effective to enhance the intensity of electron current passing through the reaction device. This is because the efficiency of the ECD reaction is generally proportional to the intensity of the electron current. When a strong electron current can be used, the reaction rate is increased, thereby allowing high speed acquisition of spectra. On the other hand, the efficiency of ion utilization is low because the efficiency of ion injection into the ECD device is low. As the result, a long integration time is required and high speed acquisition of spectra has not been achieved.

However, these two have a mutually contradictory aspect. That is, the reality of the system using the linear ion trap shows that the efficiency of ion injection tends to decrease as the intensity of electron current increases. This is due to the fact that the surface condition of a wall electrode is changed by the strong electron current, electrons are charged on the surface, and a voltage to control ions is not properly applied. In Non-patent Document 4, a phenomenon in which the efficiency of ion injection is typically decreased to approximately one tenth by electron irradiation has been observed.

The present invention solves the above problems in the ECD device using the linear RF ion trap and discloses a reaction device capable of realizing a high speed ECD reaction comparable to CID and a mass spectrometer provided with the reaction device. At the same time, a mass spectrometer to obtain useful analytical information in combination of ECD enhanced in speed and CID and its operation method are disclosed.

To solve one problem in speeding up spectral acquisition, that is, to obtain strong electron current, a linear combined type of ion trap, in which a magnetic field is applied to a linear ion trap formed of linear multipole electrodes and wall electrodes in parallel with the central axis thereof, and an electron source are used, and particularly, not only is the electron source positioned on the outside of the linear multipole electrodes with respect to the wall electrode but also it is placed at a position on the extension of magnetic lines of force being applied to the inside of the linear multipole electrodes when the magnetic lines of force are traced toward the outside thereof.

To solve another problem in speeding up spectral acquisition, that is, to obtain high efficiency of ion injection and further avoid the influence of electron current on the efficiency of ion trap, an electron inlet to the linear RF ion trap and an ion inlet are separated. At this time, the wall electrode on the ion injection side of the linear ion trap is placed in the inside of the space where the magnetic lines of force passing through the inside of the ion trap are distributed. Owing to this arrangement, electrons not involved in the ECD reaction are absorbed by the surface of the wall electrode on the side of the linear multipole ion trap. In other words, ions are not subjected to change in voltage for ion manipulation in which electrons participate before the ions are injected into the inside of the linear ion trap. Further, it is effective to increase the efficiency of electron absorption by applying gold plating and the like to the surface that absorbs electrons in the ion trap, which also secure electric conductivity by avoiding chemical change of the surface caused by electron irradiation.

In Patent Document 5, there is a disclosed example in which, when electrons are injected into an ion guide not having an ion trap function, an electron source formed of a filament or an electron source formed of a cylindrical dispenser cathode is placed at a position on the extension of magnetic lines of force being applied to the ion guide. The electron source is made in a circular shape surrounding the central axis or in a cylindrical shape so as not to interfere with ion injection. However, it may be impossible in principle to obtain an intense electron beam by this system. This is because an electrode to draw out thermal electrons produced on the surface of the filament or the dispenser cathode into vacuum is not present. If the electron source is biased against the linear electrodes to draw out the electrons, the electrons are accelerated, and therefore, it is difficult to inject low energy electrons into the linear electrodes. Further, the electron source is exposed to RF in this system. Thus, it is difficult to avoid heating of electrons in this system and to implement ECD that requires an electron energy of approximately 1 eV. Furthermore, it is reported that time enough for the ECD reaction can not be obtained only by passing the ions through electron cloud trapped in the ion guide used (Non-patent Document 5).

On the other hand, in the present disclosure, the wall electrodes of the ion trap are present, and the electron source is placed on the outside thereof. Since the wall electrodes shield an RF electric field, electrons are not heated by RF in the vicinity of the electron source. The electrons are drawn out from the electron source with high efficiency owing to the arrangement of the wall electrode or an electron-drawing electrode additionally placed, then decelerated by a potential difference between the ion trap and the wall electrode or the drawing electrode, and injected into the inside of the ion trap as low energy electrons. Further, the electron source can be placed on the central axis by separating the ion inlet and the electron inlet. This has an effect to increase an overlapping of the electrons and electrons trapped in the linear multipole electrodes, thereby leading to an enhancement of the efficiency of the ECD reaction. Furthermore, in the present disclosure in which ions are retained in the linear multipole electrodes, it is possible to give a sufficient time for the reaction between ions and electrons. As described above, it is understood that the ion trap structure applied with a magnetic field shown in the present disclosure is essential for obtaining a strong ion current.

On the other hand, in Non-patent Document 4, an example using a linear multipole ion trap is disclosed, and therefore, wall electrodes are present and an electron source is arranged on the outside thereof. In the example, a region where no magnetic field is present is provided using magnetic shield, and the electron source is arranged within the region. Although electrons are tried to be injected by focusing with an electrostatic lens system, the efficiency of their injection is only approximately 1 to 10%. By placing the electron source at a position on the extension of magnetic lines of force being applied to the inside of the linear multipole electrodes when the magnetic lines of force are traced toward the outside thereof as in the present disclosure, electrons are allowed to move along the magnetic lines of force, and thus the electrons can reach up to parent ions in the inside of the linear multipole electrodes at an efficiency close to approximately 100%. As described above, it is apparently essential to arrange the electron source in the magnetic field in order to obtain electron intensity.

When the above problems are solved, the acquisition time of ECD spectrum becomes approximately one hundredth. This is because the reaction rate is expected to be typically increased tenfold and the efficiency of ion utilization is expected to be increased tenfold. As the result, the time required for acquisition of one ECD spectrum becomes approximately 300 milliseconds, which is almost comparable to the acquisition time of a dissociation spectrum with the use of CID.

When an ECD spectrum and CID spectrum have become obtainable within approximately the same time, it is effective to allow ECD and CID to be performed in the inside of a reaction device having one set of linear multipole electrodes in order to obtain complementary data by the combination of ECD and CID with a small and low-cost device. For this purpose, it is effective to stop application of a magnetic field while performing CID in order to secure high mass resolution in resonance oscillation of ions performed for CID. The reason is that oscillation frequency of ions in the surface perpendicular to the central axis is separated into two by the magnetic field. In other words, the magnetic field for ECD is applied by an electromagnet or a solenoid coil, the magnetic field is applied while performing the ECD, and application of the magnetic field is stopped while performing CID.

Both Patent Document 5 and Non-patent Document 4 disclose the use of an electromagnet or the use of a solenoid coil as a means to apply a magnetic field. However, it is not mentioned that stopping application of the magnetic field is necessary for performing CID.

According to the present invention, speedup of spectral acquisition is achieved by ECD reaction unit using an RF ion trap and its combination with CID is made easy. As the result, speedup of amino acid sequence analysis and the like is achieved and speedup of structural analysis of a protein sample and a protein sample with post-translational modification.

DETAILED DESCRIPTION OF THE PREFERRED EMBODIMENTS

In the following embodiments of the present invention, means for solving specific problems and examples of the embodiments are explained.

Figure 1:
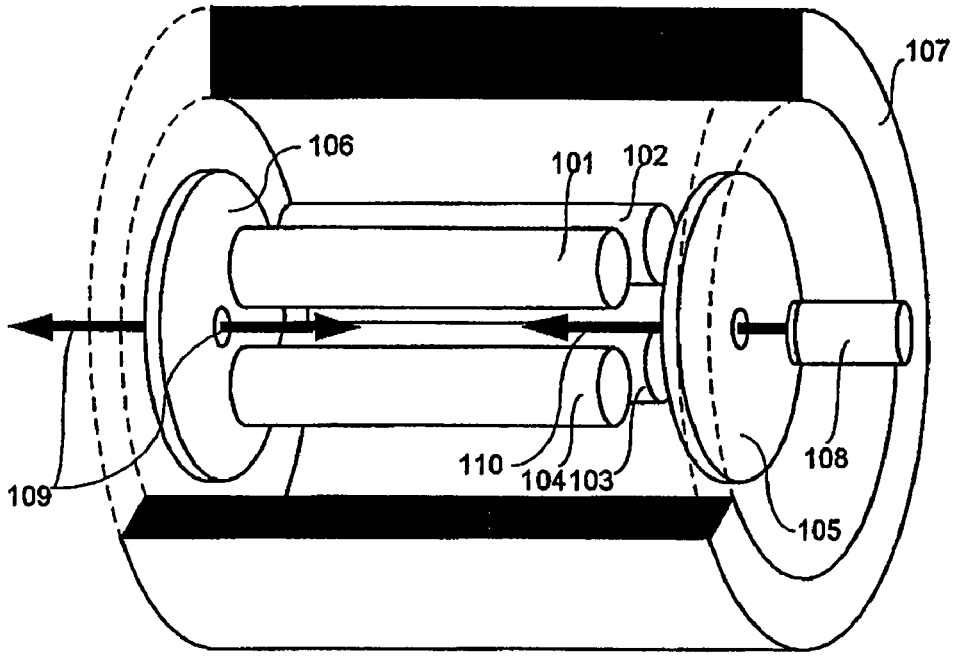
FIG. 1 is a schematic diagram to explain an example of an electron capture dissociation (ECD) cell.
Figure 2:
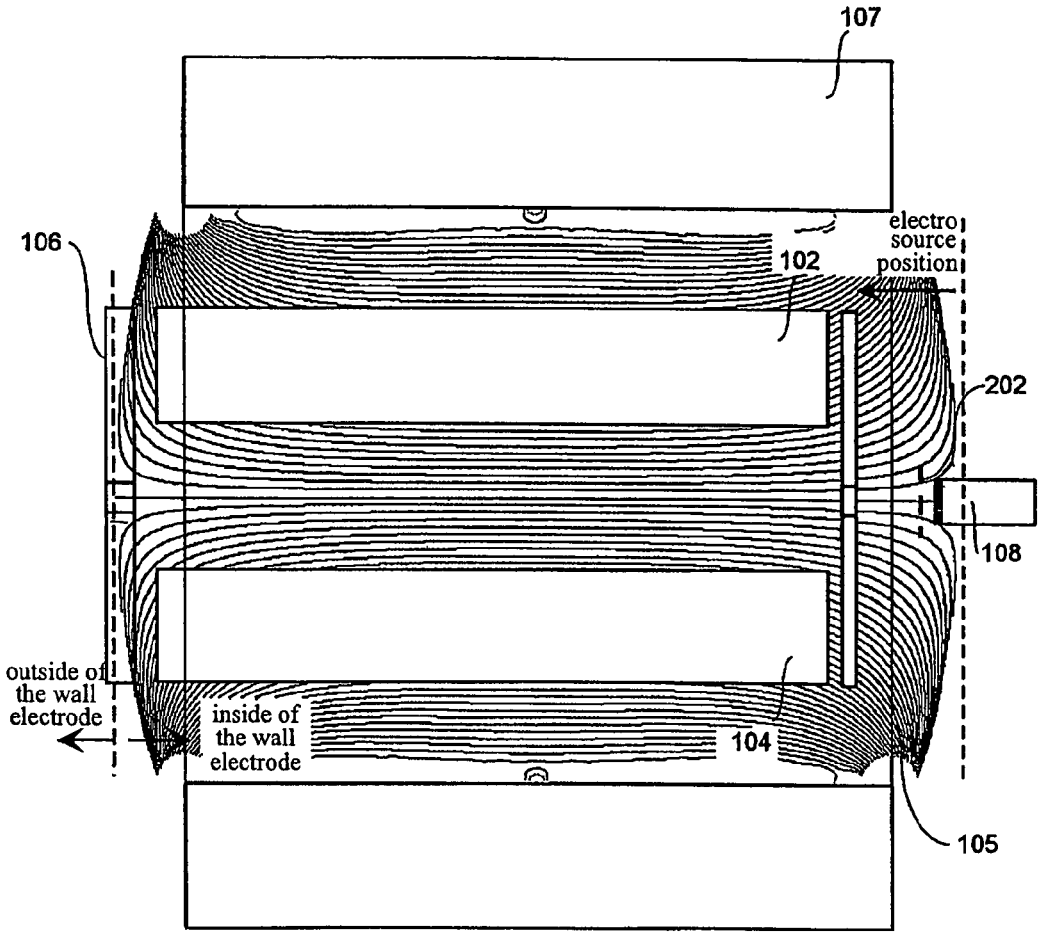
FIG. 2 is a schematic diagram to explain lines of magnetic force in the inside of a cylindrical magnet and an electron source position.

FIG. 1 is a schematic diagram to explain an example of an electron capture dissociation (ECD) device, i.e., an ECD cell of the present disclosure. A linear multipole electrode ion trap unit includes electrodes 101-104 forming a linear multipole electrode structure having linear quadrupole electrodes and two wall electrodes 105 and 106. Ions are injected from one port of the linear multipole electrode ion trap as shown by an arrow 109 indicating their loading and unloading. Magnetic field is generated by a cylindrical permanent magnet 107 in its inside. Electrons are generated by an electron source 108 formed of a dispenser cathode and injected from a port opposite to the ion inlet as shown by an arrow 110 indicating electron incidence. At this time, the electron source is placed on the side opposite to the linear multipole electrodes and adjacently to one of the wall electrodes. FIG. 2 is a schematic diagram showing lines of magnetic force in the inside of the cylindrical magnet and a position to arrange the electron source. Thermal electrons generated by the electron source 108 are drawn out by a force due to a voltage applied to a drawing electrode 202, resulting in an electron current. The electron generation site of the electron source 201 is typically placed not only on the outside of the wall electrode 105 but also in the inside of the region where the lines of magnetic force passing through the inside of the cylindrical magnet are present. The limit of magnetic field where the magnetic lines of force passing through the inside of the cylindrical magnet are present is shown by a dotted line in FIG. 2 as a limit of the electron source position. Highly efficient injection of electrons becomes possible by placing the electron generation site of the electron source on the side closer to the wall electrode from this line. That is, electrons are transported into the inside of the ion trap while spirally moving along the lines of magnetic force. When the electron generation site is placed outside this line, the lines of magnetic force thereat are directed toward the cylindrical magnet 107, and therefore electrons are not directed to the ion trap and the electrons can not be injected with high efficiency. To determine the limit of the electron source position, the magnetic field is either computed by a computer or actually measured for every shape of the magnet.

Figure 3:
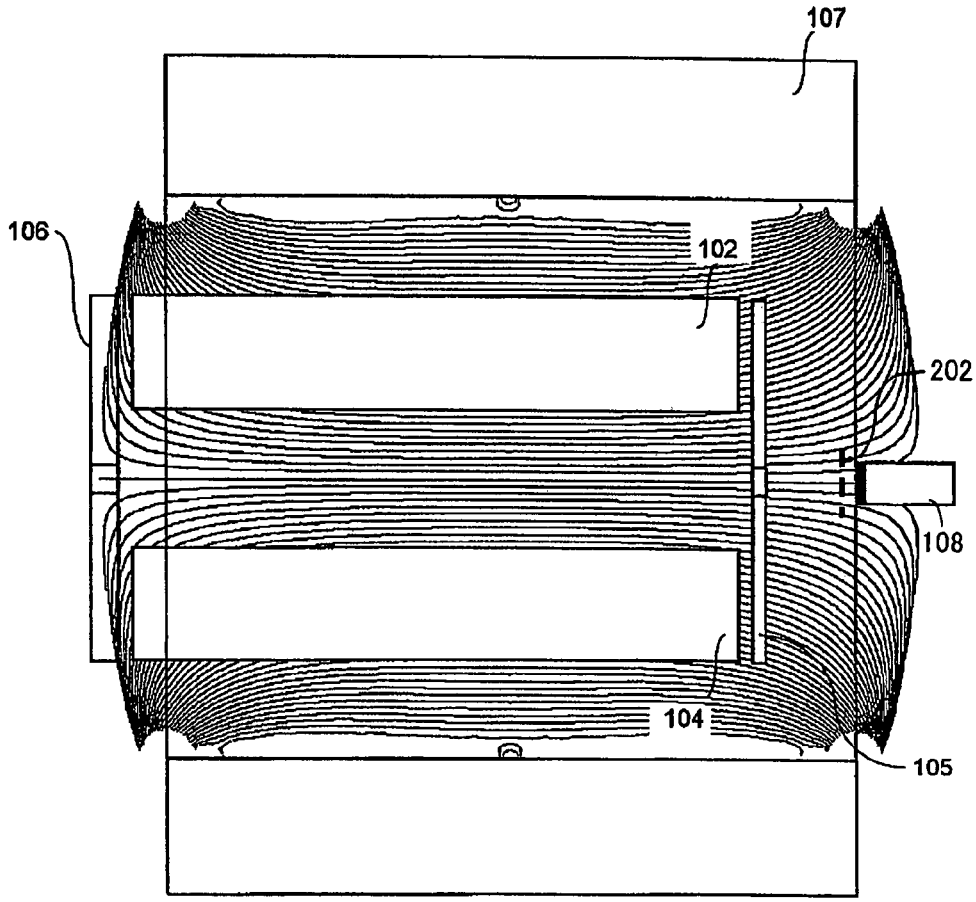
FIG. 3 is a schematic diagram to explain the lines of magnetic force in the inside of the cylindrical magnet and the electron source position.

However, in order to save trouble of computation or actual measurement of the magnetic field, it is effective to securely arrange the electron generation site of the electron source 108 inside the region where the lines of magnetic force passing through the inside of the cylindrical magnet are present by means of placing the cylindrical magnet so that the wall electrode 202 on the electron source side becomes the inside the cylindrical edge surface and further placing the electron generation site of the electron source 108 on the edge surface of the cylindrical magnet or the inside therefrom. FIG. 3 is a schematic diagram to explain such an arrangement of the electron source.

An electron inlet opened through the wall electrode 105 is opened to a size approximately equal to that of the lines of magnetic force passing through the effective surface of the electron source 201 where electrons are generated. In this way, it becomes possible to inject approximately 100% of the electrons into the inside of the linear multipole ion trap. Since the temperature of the electron source becomes high, deposited materials such as metal are sometimes scattered from it and injected into the ion trap to possibly bring about a change in potential of the trap. Therefore, it is not effective for performance of the ion trap to make the opening larger than the size of the inlet opened as described above.

Further, an effective arrangement position of the wall electrode 106 having an ion inlet is explained in FIG. 2. That is, the limit where the magnetic lines of force passing through the ion trap region surrounded by the linear multipole electrodes are present is illustrated as the limit of the wall electrode position. In the present disclosure, typically, the inner wall of the wall electrode 106 is placed so as to be on the inside of the limit of the wall electrode position and allow the magnetic field to pass through the surface thereof, and further, the outer wall of the wall electrode is placed on the outside of the limit of the wall electrode position. Owing to this arrangement position, electrons produced by the electron source 108 and allowed to pass through the linear multipole electrodes are captured by the wall electrode 106. When the inner wall of the wall electrode is placed outside the limit of the wall electrode position, electrons wind about the magnetic field to be absorbed on the cylindrical magnet 107 or the RF multipole electrodes 102 and 104. Further, when the outer wall of the wall electrode is placed inside the limit of the wall electrode position, electrons leak out of the ion inlet opened through the wall electrode 106 to be absorbed outside the wall electrode. This possibly brings about a change in static potential of the outside of the wall electrode, thus exerting an effect on the efficiency of ion injection. Furthermore, this wall electrode 106 is typically connected to an ammeter that detects electron current flowing in. The electron current captured at the wall electrode 106 in approximately 100% is an important parameter to optimize the efficiency of an ECD reaction, and the connection of the ammeter to this electrode makes the measurement possible.

In addition, it is effective for highly efficient injection of ions and stable monitoring of electron intensity to make the wall electrode 106 chemically stable by plating with gold graphite particle and the like and avoid a change of the surface caused by electron irradiation.

The principle of ion trap in a linear quadrupole RF ion trap and the theoretical discussion of the influence on electrons by RF electric field are described in Non-patent Document 4, and therefore, these descriptions are omitted here.

Figure 4:
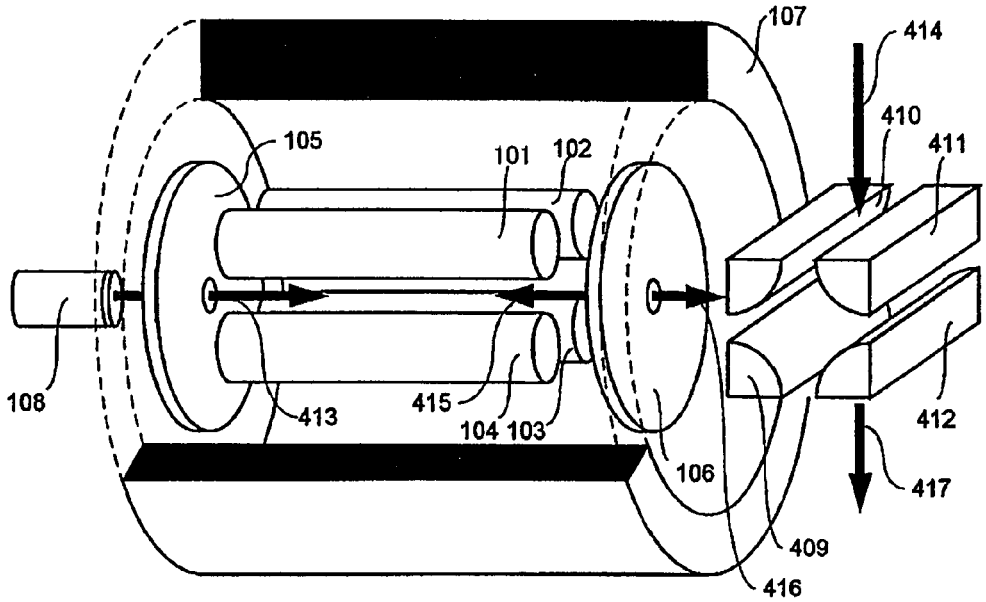
FIG. 4 is a schematic diagram to explain an example of another ECD cell provided with a quadrupole deflector.

FIG. 4 is a schematic diagram to explain an example of an ECD cell provided with a quadrupole deflector. The structure of the ECD cell portion is the same as in FIG. 1 and its explanation is omitted. In the present example, the quadrupole deflector 409 to 412 is typically provided adjacently to the wall electrode 106 not on the side of the electron source. As for ions in the present disclosure, parent ions produced by an ion source unit are injected into the ECD cell from the one wall electrode 106 as shown by an arrow 415, and product ions after a reaction are ejected from the same port to be injected into a mass analysis unit as shown by an arrow 416. When the ion source unit and the mass analysis unit cannot coexist, for example, when an electrospray ionization (ESI) ion source and a time-of-flight (TOF) mass analysis unit are connected, ion introduction from the ion source shown by an arrow 414 and ion ejection to the mass analysis unit shown by an arrow 417 cannot coexist. Therefore, the quadrupole deflector is introduced. The quadrupole deflector consists of four electrodes 409 to 412 as shown in FIG. 4, and its principle is that the movements of charged particles are deflected by 90 degrees by applying adequate and different static voltages to the opposing electrode pairs (a pair of 409 and 411 and a pair of 410 and 412). By arranging this quadrupole deflector, ions 414 injected from the ion source are deflected by 90 degrees and then introduced into the ECD cell at the timing of injecting ions to the ECD cell, and ions 416 ejected from the ECD cell are deflected by 90 degrees and then the ions are injected into the mass analysis unit along the arrow 417 at the timing of drawing out ions. By connecting the quadrupole deflector to the ECD cell as in the present system, a mass spectrometer provided with an ECD function can be constructed.

Figure 5:
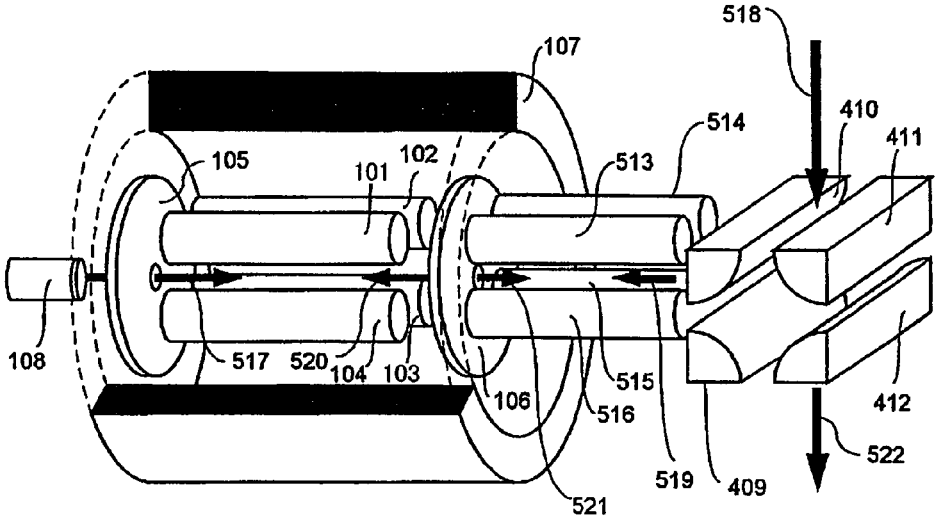
FIG. 5 is a schematic diagram to explain an example of still another ECD cell provided with the quadrupole deflector and an ion guide.

FIG. 5 is a schematic diagram to explain an example of an ECD cell provided with the quadrupole deflector and an ion guide. That is, in the ECD cell provided with the quadrupole deflector shown in FIG. 4, an RF ion guide formed of RF multipole electrodes 513 to 516 that are applied with RF voltage is inserted between the ECD cell and the quadrupole deflector.

The inevitability of inserting the ion guide is also to aim at avoiding an effect of the magnetic field on other mass analysis units. When a permanent magnet, or a constantly energized electromagnet or solenoid coil is used as a magnetic field-generating unit of the ECD cell, the magnetic field leaks out to the outside of the ECD cell. The magnetic field exerts an effect on other analysis units, particularly on an ion trap, and there is a possibility that oscillation frequency of ions is changed when mass analysis is performed, parent ions are isolated, CID is performed, and so forth. Therefore, a distance is provided between the ion source arranged with the quadrupole deflector as well as a line arranged with the mass analysis units and the ECD cell is secured in order to place the ECD cell that generates a magnetic field at all times separately from other mass analysis units. For this purpose, its length is typically adjusted so that the intensity of the magnetic field decays to a level equal to or lower than 1 mT at the quadrupole deflector part. It has been confirmed by a simulation that its effect on the vibration frequency of ions can be decreased to a level equal to or lower than 1% when the intensity of the magnetic field decays up to 1 mT, and this condition presents no problem in operating a mass spectrometer.

In the present example, ions produced by the ion source are injected into the quadrupole deflector as shown by an arrow 518 and deflected by 90 degrees to pass through the ion guide as shown by an arrow 519. The ions are injected into the ECD cell as shown by an arrow 520 and trapped. An electron beam is irradiated thereto as shown by an arrow 517 to produce dissociated ions by an ECD reaction. The dissociated ions are drawn out from the ECD cell as shown by an arrow 521, pass through the ion guide, and arrive at the quadrupole deflector. The ions are deflected to the direction where a mass analysis unit is arranged by the quadrupole deflector to be injected into the mass analysis unit as shown by an arrow 522.

Figure 6:
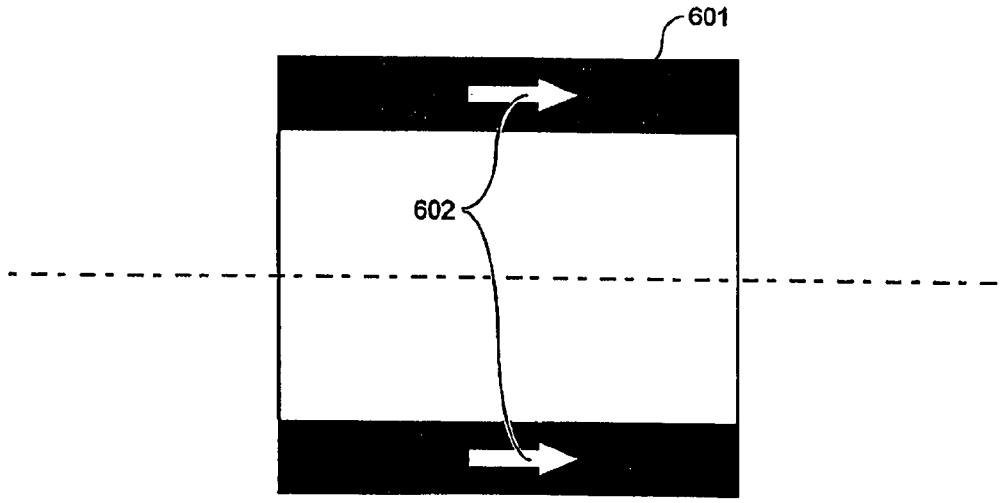
FIG. 6 is a schematic diagram to explain a magnetic field-generating unit using a cylindrical permanent magnet.

Magnetic field-generating units that are employed for the above ECD cell are explained below. FIG. 6 is a schematic diagram to explain a magnetic field-generating unit using a cylindrical permanent magnet 601 that is a system employed and exemplified in FIGS. 1 to 4. The direction of magnetization is shown by arrows 602. The magnetic field generated in its inside is shown in FIGS. 2 and 3. An effect of the use of a permanent magnet as a magnetic field-generating unit includes low cost and no need for a cooling system for a current source and a coil as in the case of an electromagnet and a solenoid coil. It is an effective method when the ECD cell is used as an ECD reaction unit in which no collision induced dissociation (CID) is performed.

Figure 7:
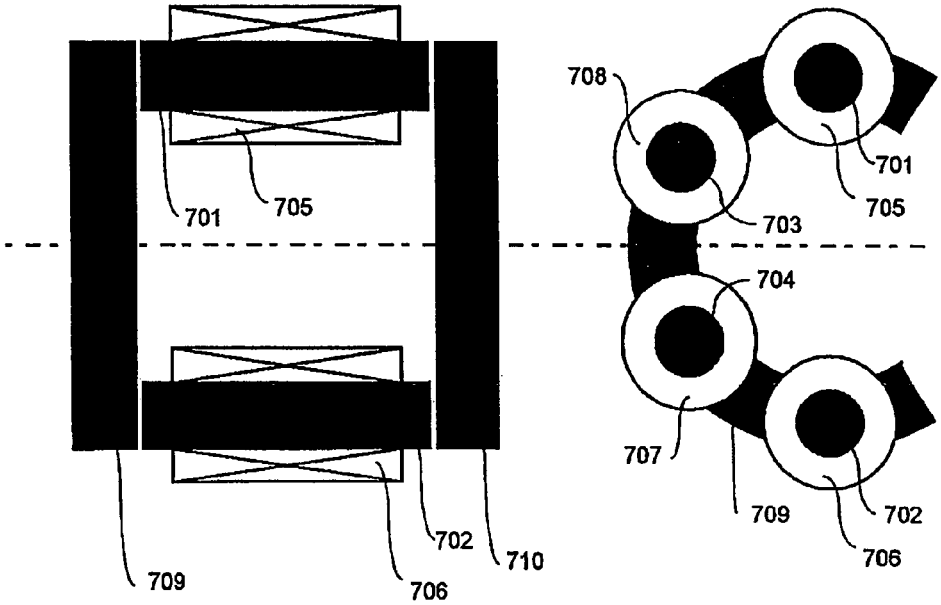
FIG. 7 is a schematic diagram to explain another magnetic field-generating unit using an electromagnet.

FIG. 7 is a schematic diagram to explain another magnetic field-generating unit in which a cylindrical magnet is formed of an electromagnet. This magnetic field-generating unit includes cylindrical magnet cores 701 to 704, magnetic poles 709 and 710, and coils 705 to 708. The coils are wound such that the directions of magnetization generated by each cylindrical magnet core become parallel to one another. Thereby magnetization just similar to the cylindrical permanent magnet is generated in the magnet poles and a magnetic field is generated along the central axis of the electromagnet in FIG. 7.

Figure 8:
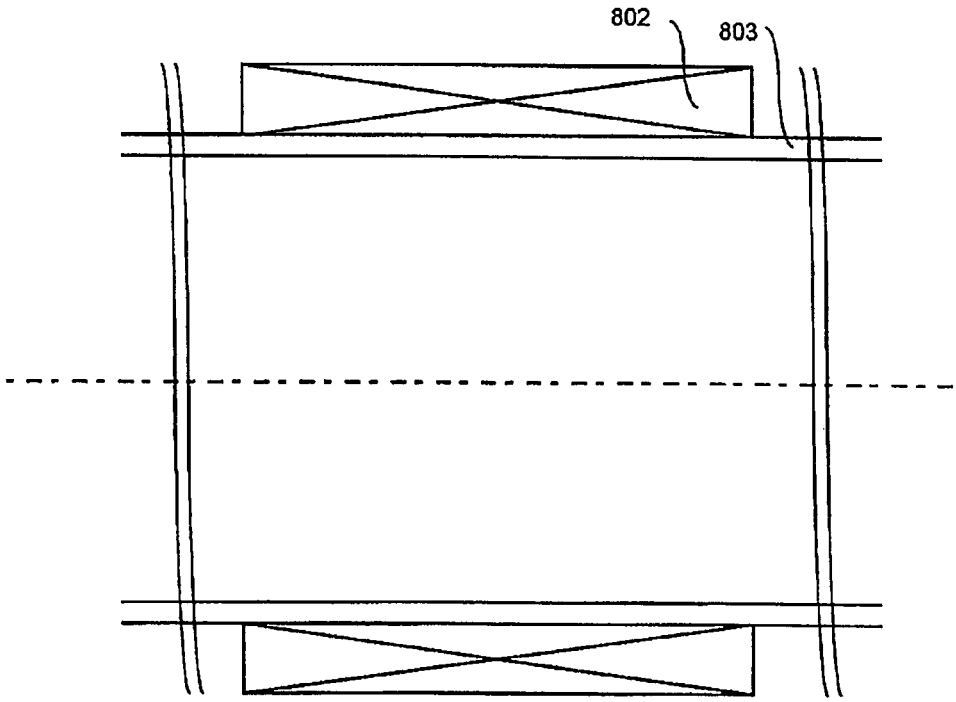
FIG. 8 is a schematic diagram to explain still another magnetic field-generating unit using a solenoid.

FIG. 8 is a schematic diagram to explain still another magnetic field-generating unit using a solenoid. A magnetic field is typically generated by a solenoid 802 placed outside a vacuum chamber 803. The magnetic field is generated in the vicinity of the central axis by passing a current through the solenoid. Since the solenoid does not have a magnetic core, it is necessary to feed a large current to generate a magnetic field required for the ECD and cooling the coil becomes essential. Placement of the solenoid outside the vacuum chamber allows easy coupling with a unit for cooling with water.

Although the magnetic field-generating units shown in the above FIGS. 7 and 8 require a current source and a cooling unit, the intensity of the magnetic field can be varied, which is largely different from a permanent magnet. In order to carry out CID in an ECD cell, it is essential to stop the magnetic field, which can be made possible by these units.

Figure 9:
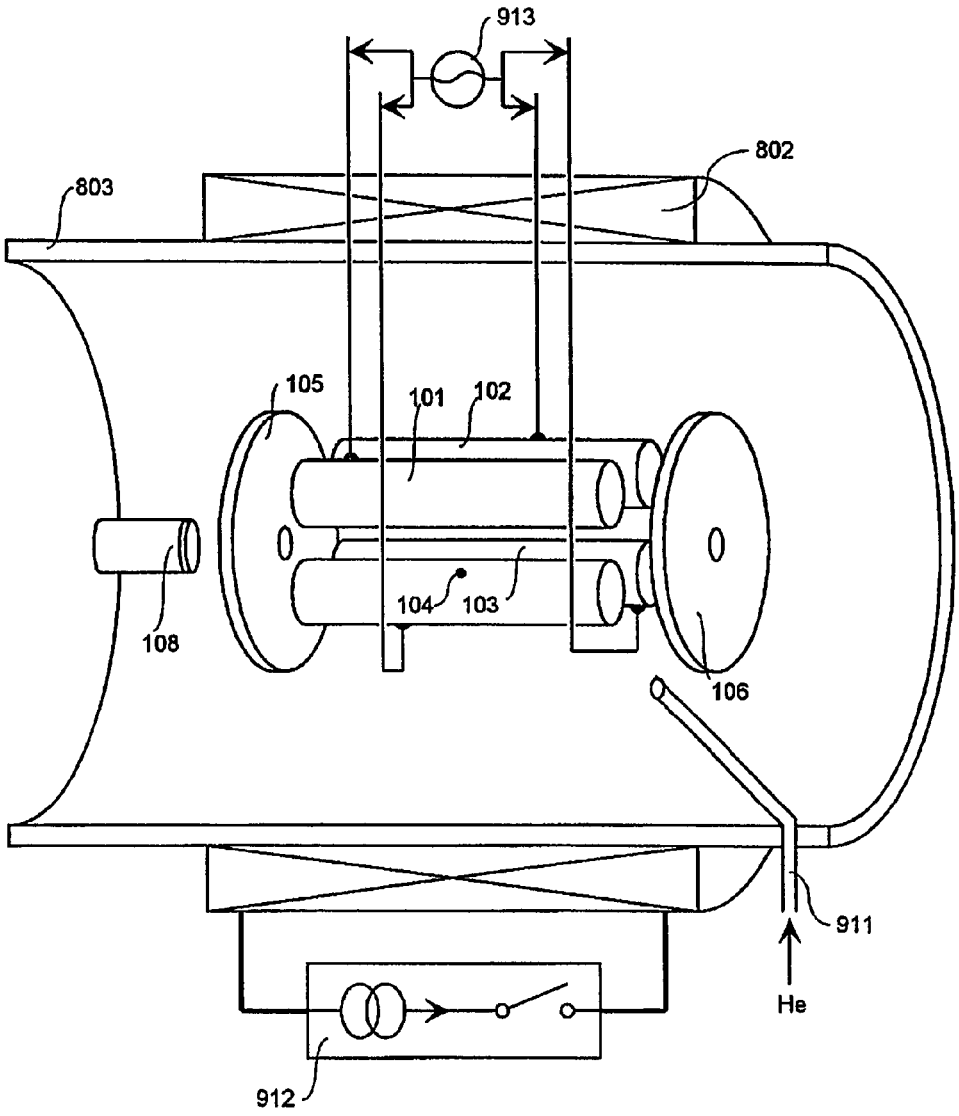
FIG. 9 is a schematic diagram to explain an example of still another ECD cell provided with the magnetic field-generating unit using the solenoid.

FIG. 9 is a schematic diagram to explain an example of an ECD cell provided with a magnetic field-generating unit using a solenoid, and it has a feature of having a CID function. That is, the linear quadrupole ion trap 101 to 105 and the electron source 108 are arranged in the magnetic field-generating unit using the solenoid in FIG. 8. An AC power source 913 is connected to the linear quadrupole electrodes to generate a dipole electric AC field in the inside thereof. The reference numeral 912 denotes a current source that supplies a current to the solenoid and can be operated by switching. Further, piping 911 to introduce He gas into the linear quadrupole ion trap is arranged. In order to make the partial pressure of He gas high by introducing a small amount of the gas, it is effective to put a cover on the linear quadrupole ion trap (not shown in FIG. 9 for simplification).

To perform CID inside the present ECD cell, the frequency of AC voltage generated by the AC power source 913 is adjusted to a value that excites resonance vibration of a target ion. Particularly, it is a feature that the magnetic field is not applied at that time by stopping the energization of the electromagnet. In this case, the resonance frequency of an ion is a frequency corresponding to the frequency of secular motion in the so-called pseudopotential. Since the method for its computation is basic knowledge for an engineer in the present field, its explanation is omitted here.

Further, it is practically possible to allow reactions to proceed sequentially by combining ECD and CID using the present ECD cell. In this case, an arbitrary ion species among a plurality of dissociated ions produced by ECD or CID is selected, and the selected ion species is further continuously subjected to ECD or CID. When this operation for isolating a dissociated ion species is conducted, ions other than the target ions are ejected by resonance with secular motion. It is a feature that the magnetic field is not applied at the time of this isolation operation by stopping the energization of the electromagnet. By this operation, the operation of isolating a single dissociated ion species becomes possible.

Furthermore, the ECD cell can be used as a mass spectrometer. Namely, a dipole AC electric field is applied to trapped ions, and its frequency is scanned. The ions satisfying each resonance condition are ejected by turns from the ion trap to the outside of the ECD device through an ion outlet port. It is a feature that the magnetic field is not applied at this time by stopping the energization of the electromagnet. It becomes possible to perform a conventionally known linear ion trap mass analysis by this operation of disenergizing the magnetic field (Patent Documents 6 and 7).

First Embodiment of Mass Spectrometer Provided with ECD Reaction Unit

Figure 10:
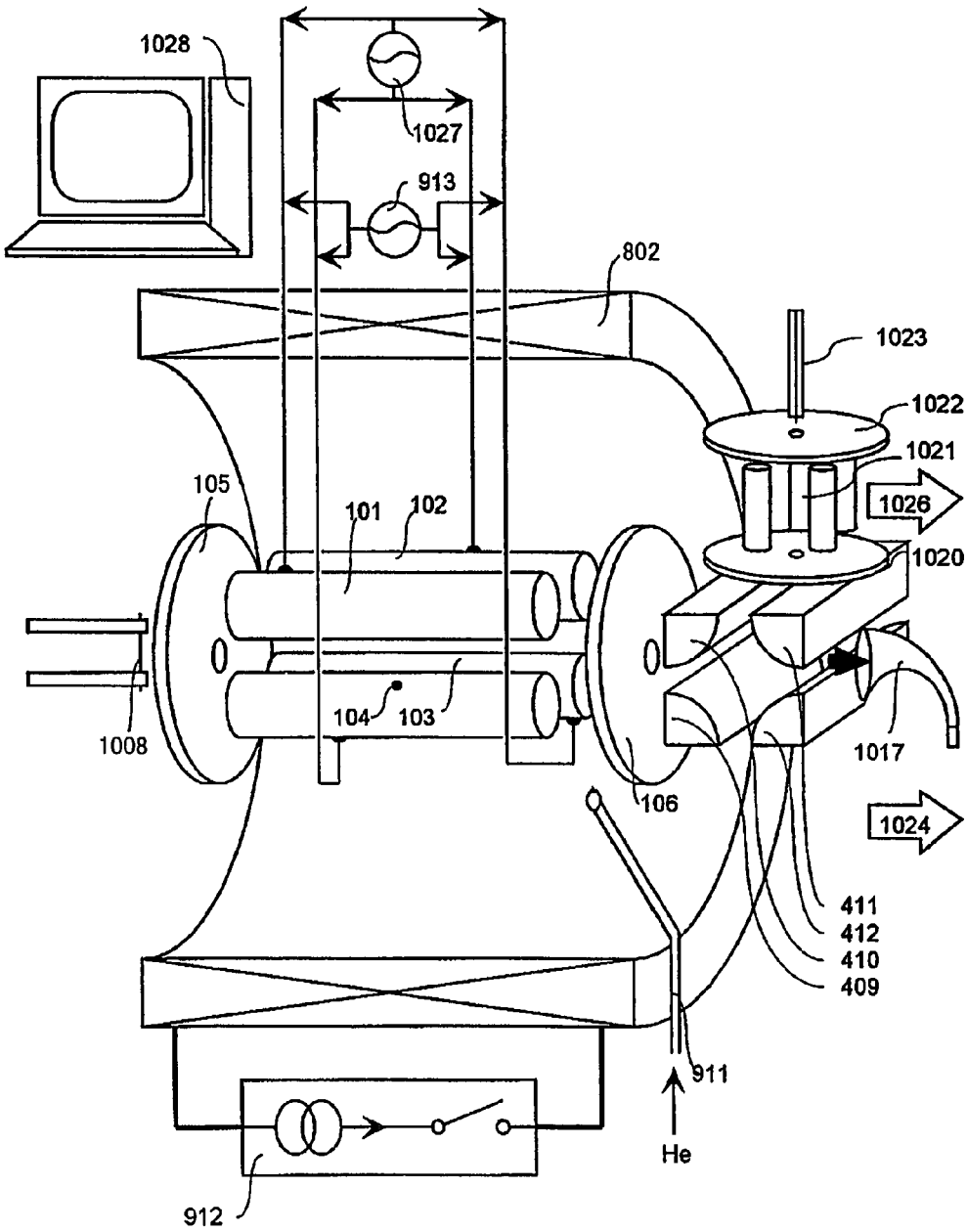
FIG. 10 is a schematic diagram to explain an example of a mass spectrometer in which the ECD cell provided with the magnetic field-generating unit using the solenoid is employed for ECD and mass analysis.

FIG. 10 is a schematic diagram to explain an example of a mass spectrometer in which an ECD cell provided with a magnetic field-generating unit using a solenoid is employed for ECD and CID and this reaction cell is employed for mass analysis. It is a feature that an ion source is provided to one ion inlet of a quadrupole deflector and an ion detector is provided to the other inlet.

The ECD and CID reaction unit includes the electrodes 101 to 104 forming linear multipole electrodes, an RF power source 1027 to apply an ion trap RF thereto, the AC power source 913 to resonate ions, the wall electrodes 105 and 106, the solenoid coil 802 and the driving current source thereof 912, an electron source 1008 formed of a filament, the helium gas inlet pipe 911, and the quadrupole deflector 409 to 412. In addition to the present ECD and CID unit, a mass spectrometer is formed by further including an ESI ion source composed of a capillary electrode 1023 and a pore electrode 1022, a differential exhaust unit (exhaustion by a vacuum pump is shown by an arrow 1026) provided with an ion guide 1021, an ion detector 1017, and a computer 1028 to control the analyzer.

Precursor ions produced by the ion source can be trapped in a linear ion trap by making the voltage of the two wall electrodes positive against the linear ion trap electrodes 101 to 104 forming the ECD–CID reaction part. Alternatively, by allowing the ion guide to operate as an ion trap, the voltage to the wall electrode 106 is made approximately equal to or lower than the voltage of the linear quadrupole electrodes 101 to 104 at the timing when ejected ions pass through the wall electrode 106, and a bias to the wall electrode 106 is made higher than the voltage of the linear quadrupole electrodes 101 to 104 at the timing when the ions are located in the linear quadrupole electrodes 101 to 104, thereby creating a wall to trap the ions.

Figure 15:
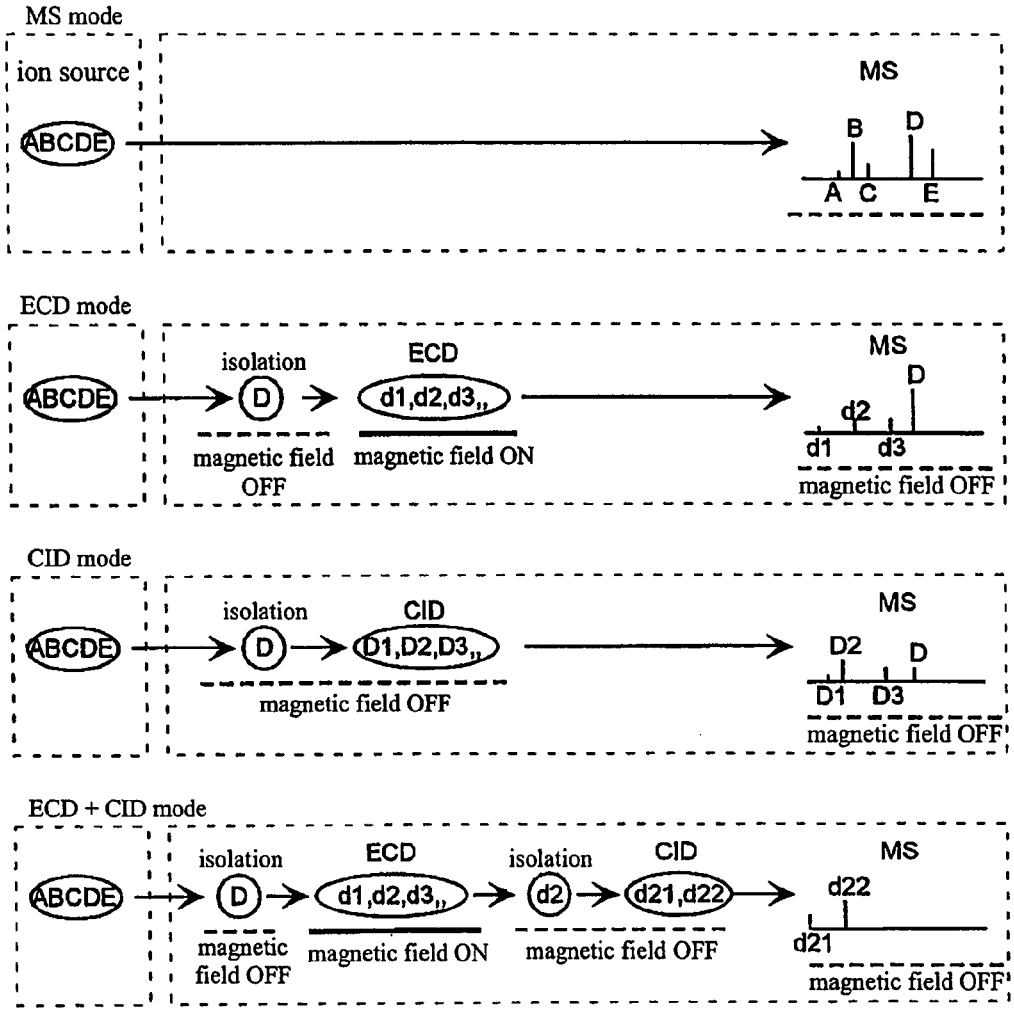
FIG. 15 is a schematic diagram to explain an operation example of the mass spectrometer in which the ECD cell is used for ECD and mass analysis.

FIG. 15 is a schematic diagram to explain a basic operation of the mass spectrometer provided with the ECD shown in FIG. 10. An MS mode in which all ions contained in sample ions are mass analyzed, an ECD mode to perform ECD, a CID mode to perform CID, and an ECD+CID mode in combination of ECD and CID are explained.

Of the two dotted frames constituting each mode, the left dotted frame indicates an ion source, and an example containing five kinds of ions, A, B, C, D, and E as ions produced by the ion source is shown. The right dotted frame shows an operation in a reaction part having ECD–CID functions.

In the MS mode, a mass spectrum of sample ions is obtained. First, the ions produced by the ion source are trapped by the ECD–CID reaction part. In the state that application of the magnetic field is stopped, a spectrum of the sample ions is obtained by mass analysis. With reference to the mass spectrum obtained here, parent ions to be analyzed for sequence structure are selected. A linear ion trap part constituting the ECD–CID reaction part acts for linear ion trap mass analysis as exemplified in a method described by J. W. Hager, Rapid commun. Mass Spectrom. 2002, vol. 16, pp. 512-526. That is, the ions are mass selectively ejected from the linear ion trap, allowed to pass through the quadrupole deflector, and detected by the ion detector 1017.

A method to carry out the ECD mode is explained. In the ECD mode, a spectrum of ions dissociated by an ECD reaction of the isolated parent ions is obtained. A current is fed through the filament 1008 all the time, keeping it in a heated state. The ions A, B, C, D, and E produced by the ion source are injected into the ECD–CID reaction part and isolated. In the figure, the ion species D is isolated. At the time of this operation, application of the magnetic field is stopped. ECD is carried out for the isolated ions. During the period of the operation of ECD, the current source 912 to supply a current to the solenoid is kept on to generate a magnetic field inside the reaction cell. When the static voltage of the electron source is set to a voltage higher than 0 V with respect to the linear quadrupole electrodes 101 to 104, the ions are injected into the ECD reaction unit. The injection of low energy electrons allows an ECD reaction to proceed, thereby producing ions d1, d2, and d3 dissociated by the ECD. The application of the magnetic field is again stopped, followed by subjecting to mass analysis to obtain a spectrum of the dissociated ions.

A method to carry out the CID mode is explained. In the CID mode, a spectrum of ions dissociated by a CID reaction of the isolated parent ions is obtained. During the period of the operation of CID, the ECD–CID reaction unit is introduced with helium gas. This is because CID is caused by collision of this gas with the vibrating parent ions. During the period of the operation of ECD as well, helium gas may be introduced. The ions A, B, C, D, and E produced by the ion source are injected into the ECD–CID reaction part and isolated. In the figure, the ion species D is isolated. At the time of this operation, application of the magnetic field is stopped. CID is carried out for the isolated ions. During the period of the operation of CID, the current source 912 to supply a current to the solenoid is kept off. In this state, an AC voltage having a frequency corresponding to the frequency of secular motion of the selected parent ion D of a known mass inside the linear ion trap electrodes 101 to 104 is applied using the AC power source 913. Alternatively, an amplitude of an ion trap RF generated by the RF power source 1027 is set such that resonance oscillation is generated by an AC voltage with a constant frequency. In this way, ions dissociated by CID, D1, D2, and D3, are produced. The application of the magnetic field is again stopped, followed by subjecting to mass analysis. The dissociated ions are mass selectively ejected from the ECD–CID mass analysis unit and detected by the ion detector to yield a mass spectrum.

A method to carry out the ECD–CID mode is explained. The aim of this mode is to perform dissociations of ions in a combined mode in which dissociated ion species produced by ECD is subsequently subjected to CID. By this operation, it becomes possible to identify leucine and isoleucine that are amino acid residues having identical mass or identify a molecule involved in post-translational modification where CID is performed for an ion species that is dissociated by ECD and has a molecule originating from the post-translational modification to isolate and identify the molecule participating in the post-translational modification. In a manner similar to the ECD mode, dissociated ions are produced by ECD. Then, one dissociated ion species is isolated (d2 ion is schematically isolated in FIG. 14), and CID is applied. According to mass analysis, the ions dissociated by CID are mass selectively ejected from the ECD–CID reaction unit and detected by the ion detector. During the period of the operation of this isolation, CID, and mass analysis, application of the magnetic field is stopped.

Figure 14:
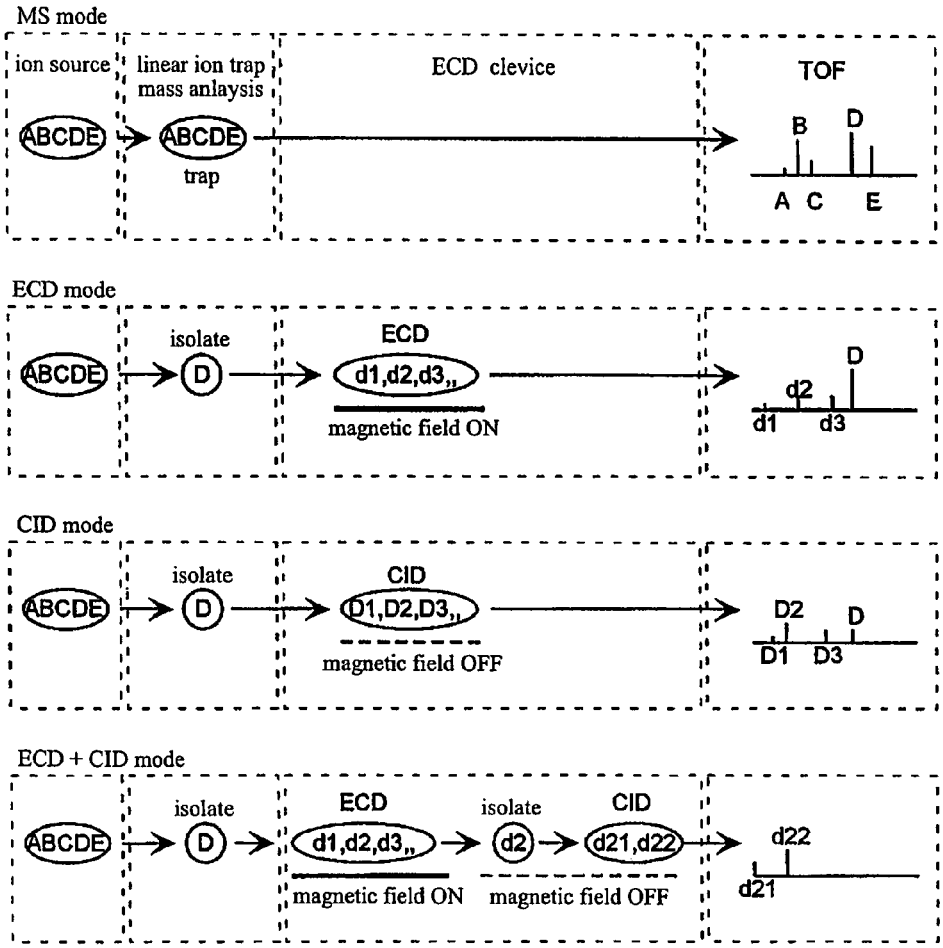
FIG. 14 is a schematic diagram to explain another operation example of the mass spectrometer in which the ECD cell provided with the quadrupole deflector is employed for ECD, and the linear ion trap mass analysis unit and the TOF mass analysis unit are provided.

Although not shown in FIG. 14, by repeating the above procedures a plurality of times as readily understood, it is possible to obtain spectra of ions subjected to multistep dissociation in which ECD and CID are arbitrarily combined. In the present embodiment, a simple structure including the ion source, the ECD–CID reaction unit serving also for mass analysis, and the ion detector is exemplified. However, it is difficult in the present embodiment to obtain a mass spectrum with high mass resolution unlike an embodiment provided with a time-of-flight (TOF) mass analysis unit shown below.

Second Embodiment of Mass Spectrometer Provided with ECD Reaction Unit

Figure 11:
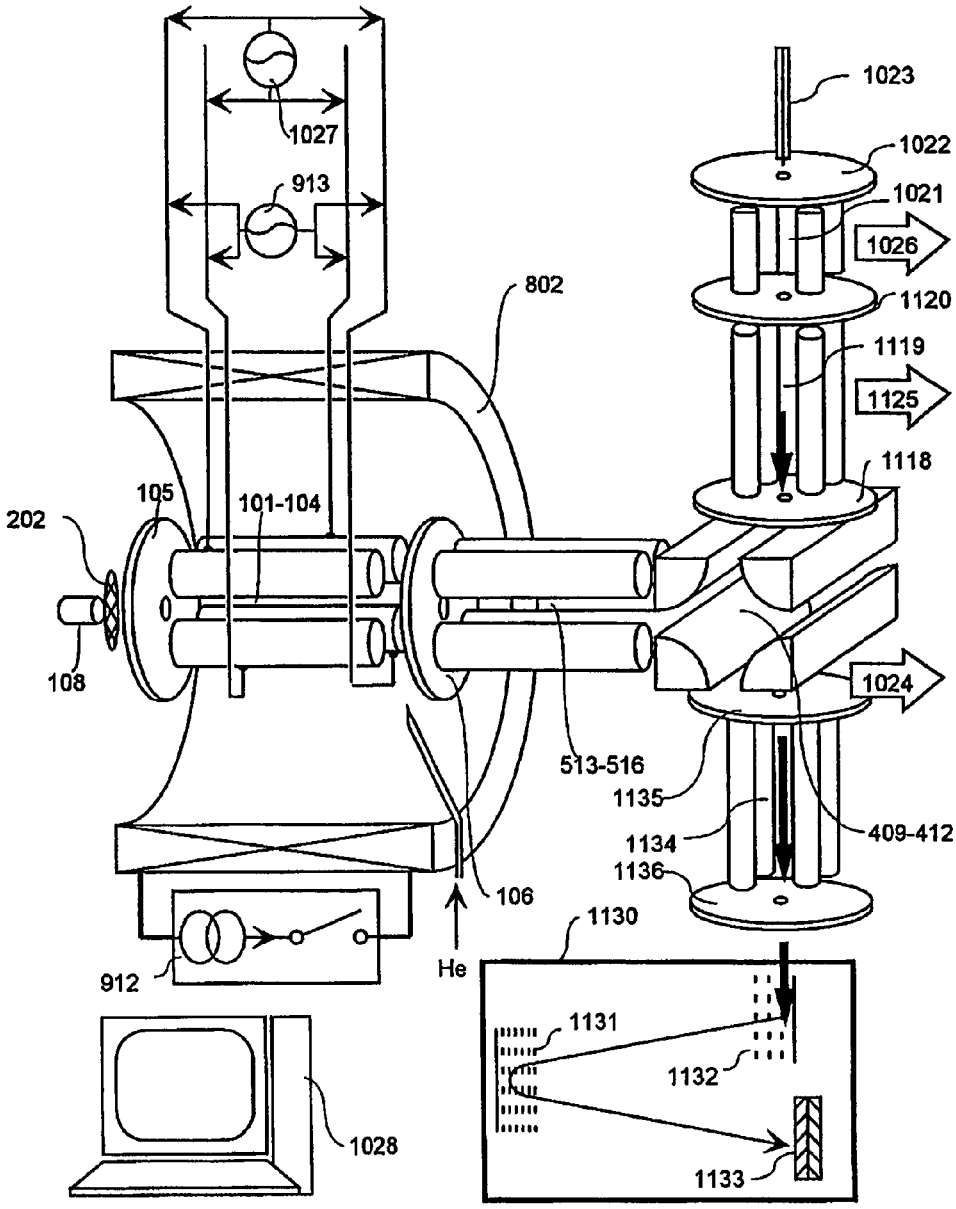
FIG. 11 is a schematic diagram to explain an example of another mass spectrometer in which the ECD cell provided with the magnetic field-generating unit using the solenoid is employed for ECD, and a linear ion trap mass analysis unit and a time-of-flight (TOF) mass analysis unit are provided.

FIG. 11 is a schematic diagram of an example to explain a mass spectrometer in which the ECD cell provided with the magnetic field-generating unit using the solenoid is employed for ECD, and a linear ion trap mass analysis unit and a TOF mass analysis unit are provided. It is a feature that, in addition to the ECD–CID reaction unit having a structure in which the solenoid is a magnetic field-generating means and the quadrupole deflector is provided, the ion source and the linear ion trap mass analysis unit are provided at one ion port of the quadrupole deflector and another mass analysis unit is provided at the other port. For the mass analysis unit, the TOF mass analysis unit with high mass resolution is employed. It is also a feature that molecular identification capability of the present embodiment becomes higher compared with the first embodiment due to high mass resolution of an obtained spectrum. In the present embodiment, an ion guide is inserted between the ECD–CID reaction unit and the quadrupole deflector, thereby avoiding that the magnetic field by the solenoid coil exerts an effect on the TOF mass analysis unit and a linear ion trap part (1018 to 1020).

The ECD and CID reaction unit includes the electrodes 101 to 104 forming the linear multipole electrodes, the RF power source 1027 to apply an ion trap RF thereto, the AC power source 913 to resonate ions, the wall electrodes 105 and 106, the solenoid coil 802 and the driving current source thereof 912, an electron source formed of a dispenser cathode 108 and a drawing electrode 202, the helium gas inlet pipe 911, and the quadrupole deflector 409 to 412. In addition to the present ECD and CID unit, a mass spectrometer is formed by further including the ESI ion source composed of the capillary electrode 1023 and the pore electrode 1022, the differential exhaust unit (exhaustion by a vacuum pump is shown by the arrow 1026) provided with the ion guide 1021, an ion isolation unit by linear ion trap consisting of a linear quadrupole RF mass analysis unit 1019 and two wall electrodes 1018 and 1020, an ion guide part (1135 and 1136) introduced with a gas, a TOF mass analysis unit (1130 to 1133), and the computer 1028 to control the analyzer.

The ion source and the operation and function of the linear quadrupole RF mass spectrometer unit 1019 of the present embodiment are the same as those in the first embodiment. The ECD–CID reaction unit is in charge of ECD reaction, CID reaction, and a function of isolating a dissociated ion species at the time of performing a multistep reaction and does not carry out mass analysis to obtain a mass spectrum, which is different from the first embodiment. The mass analysis to obtain mass spectra is in charge of the TOF mass analysis unit.

Ions that are dissociated by the ECD–CID reaction unit and measured as a mass spectrum are taken out of the ECD–CID reaction unit and deflected toward the TOF mass analysis unit by the quadrupole deflector. These ions are injected into the ion guide part (1134 and 1135) filled with a gas. These ions lose their kinetic energies by collision with the gas in this ion guide part, and as the result, are focused to the center portion of the quadrupole electrodes. When the ions are ejected from an outlet electrode 1136, these are accelerated by a static voltage between the TOF mass analysis unit and the outlet electrode 1136 to be injected into the TOF mass analysis unit. At this time, a lens electrode and a deflector electrode to adjust the traveling direction are generally inserted. The lens electrode and the deflector electrode are not shown in FIG. 11.

The ions injected into the TOF mass analysis unit are accelerated by a pulse voltage applied to a pusher 1132 and detected by an ion detector 1133 via a reflector 1131. The ion masses are calculated by measuring the time between the time of applying a pulse voltage to the pusher and the time when an ion was detected by the ion detector. The TOF mass analysis unit employed in this example is similar to the structure of generally used TOF-MS, and therefore, its detailed description is omitted here.

FIG. 14 is a schematic diagram to explain a basic operation of the mass spectrometer provided with the ECD shown in FIG. 11. An MS mode in which all ions contained in sample ions are mass analyzed, an ECD mode to perform ECD, a CID mode to perform CID, and an ECD+CID mode in combination of ECD and CID are explained.

Of the four dotted frames constituting each mode, the left dotted frame indicates the ion source, and an example containing five kinds of ions A, B, C, D, and E as ions produced by the ion source is shown. The dotted frame on the left of the center shows an operation of the linear ion trap mass analysis unit. The dotted frame on the right of the center shows an operation of the reaction part provided with ECD–CID function. The right dotted frame shows a schematic drawing of a mass spectrum obtained by mass analysis in the TOF mass analysis unit.

In the MS mode, a mass spectrum of sample ions is obtained. First, the ions produced by the ion source are trapped by the linear ion trap mass analysis unit. The trapped ions are directly injected into the TOF mass analysis unit and mass analyzed to obtain a spectrum of the sample ions. Referring to the mass spectrum obtained here, a parent ion species to be analyzed for sequence structure is selected.

A method to carry out the ECD mode is explained. In the ECD mode, a spectrum of ions dissociated by an ECD reaction of the isolated parent ions is obtained. A heater current is fed to the dispenser cathode all the time, keeping it in a constant heated condition. The ions A, B, C, D, and E produced by the ion source are injected into the linear ion trap mass analysis unit and isolated. In the figure, the ion species D is isolated. The isolated ions are ejected to be introduced into the ECD–CID reaction unit, and ECD is carried out. During the period of the operation of ECD, the current source 912 to supply a current to the solenoid is kept on to generate a magnetic field inside the reaction cell. When the static voltage of the electron source is set to a voltage higher than 0 V with respect to the linear quadrupole electrodes 101 to 104, the ions are injected into the ECD reaction unit. The injection of low energy electrons allows an ECD reaction to proceed, thereby producing ions d1, d2, and d3 dissociated by the ECD. The dissociated ions are ejected from the ECD–CID reaction unit, injected into the TOF mass analysis unit, and subjected to TOF mass analysis to obtain a spectrum of the dissociated ions.

A method to carry out the CID mode is explained. In the CID mode, a spectrum of ions dissociated by a CID reaction of the isolated parent ions is obtained. During the period of the operation of CID, the ECD–CID reaction unit is introduced with helium gas. This is because CID is caused by collision of this gas with the vibrating parent ions. During the period of the operation of ECD as well, helium gas may be supplied. The ions A, B, C, D, and E produced by the ion source are injected into the linear ion trap mass analysis unit and isolated. In the figure, the ion species D is isolated. The isolated ions are injected into the ECD–CID reaction unit. CID is performed for this ion species. During the period of the operation of CID, the current source 912 to supply a current to the solenoid is kept off. In this state, an AC voltage having a frequency corresponding to the frequency of secular motion of the selected parent ion D of a known mass inside the linear ion trap electrodes 101 to 104 is applied using the AC power source 913. Alternatively, an amplitude of ion trap RF generated by the RF power source 1027 is set such that resonance vibration is generated by an AC voltage with a constant frequency. In this way, ions dissociated by CID, D1, D2, and D3, are produced. The dissociated ions are injected into the TOF mass analysis unit to obtain a mass spectrum. It should be noted that CID may also be performed in the linear ion trap mass analysis unit according to a conventional method.

A method to carry out the ECD–CID mode is explained. The aim of this mode is to perform dissociations of ions in a combined mode in which a dissociated ion species produced by ECD is subsequently subjected to CID. By this operation, it becomes possible to differentiate between leucine and isoleucine that are amino acid residues having identical mass or to identify a molecule involved in post-translational modification where CID is performed for an ion species that is dissociated by ECD and has a molecule originating from the post-translational modification to isolate and identify the molecule participating in the post-translational modification. In a manner similar to the ECD mode, dissociated ions are produced by ECD. Then, one dissociated ion species is isolated (d2 ion is schematically isolated in FIG. 14), and CID is applied. During the period of the operation of this isolation and CID, application of the magnetic field is stopped. The ions dissociated by CID are injected into the TOF mass analysis unit and a mass spectrum is obtained by mass analysis.

Figure 13:
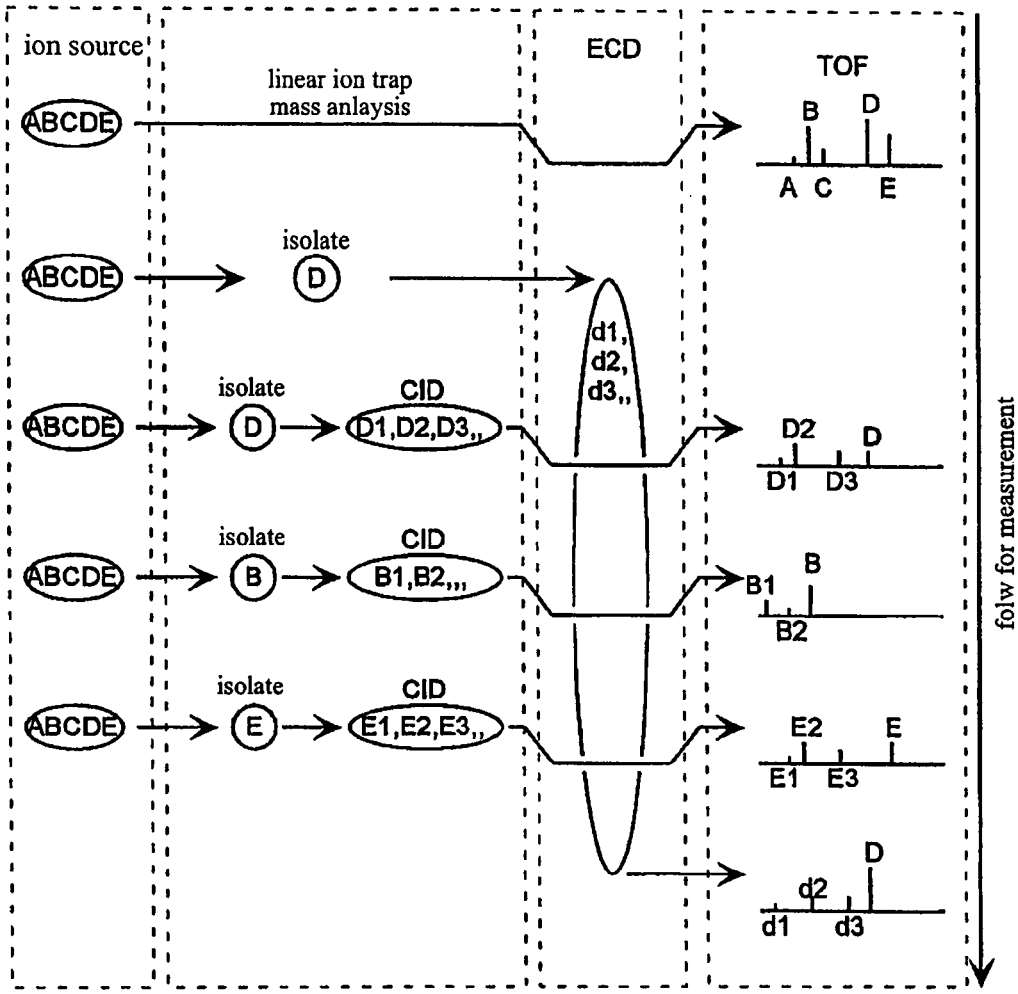
FIG. 13 is a schematic diagram to explain an operation example of the mass spectrometer in which the ECD cell provided with the quadrupole deflector is employed for ECD, and the linear ion trap mass analysis unit and the TOF mass analysis unit are provided.

FIG. 13 is a schematic diagram to explain an operation of a sophisticated mass analysis. Namely, this is a method in which the linear ion trap mass analysis unit is operated as a means for CID during the period of the operation of ECD. Since it is said that the reaction speed of ECD may be slow, a rather long time is sometimes required for the operation of ECD. By acquiring a plurality of CID spectra during the period of this operation of ECD, analytical throughput is increased, thereby enhancing the analytical capability. In the analyzer of the present embodiment, the operation is made possible by the fact that the ECD reaction unit can be separated from the linear ion trap mass analysis unit and the TOF mass analysis unit.

As shown in FIG. 13, the MS mode is carried out first. Subsequently, the isolated target ions (ion species D in the figure) are injected into the ECD reaction unit, and ECD is performed. During that time, the linear ion trap is operated as the means for CID, and a plurality of CID spectra are obtained. In the figure, CID spectra of B ion, D ion, and E ion are obtained. During the period of this CID, electrons are irradiated to produce many ECD-dissociated ions. Finally, these ions are injected into the TOF mass analysis unit to obtain an ECD-dissociated spectrum, d1 to d3. The present embodiment not only has a high mass resolution achieved by the TOF mass analysis unit but also represents an example of the most multifunctional analyzer capable of performing ECD and CID.

Third Embodiment of Mass spectrometer Provided with ECD Reaction Unit

Figure 12:
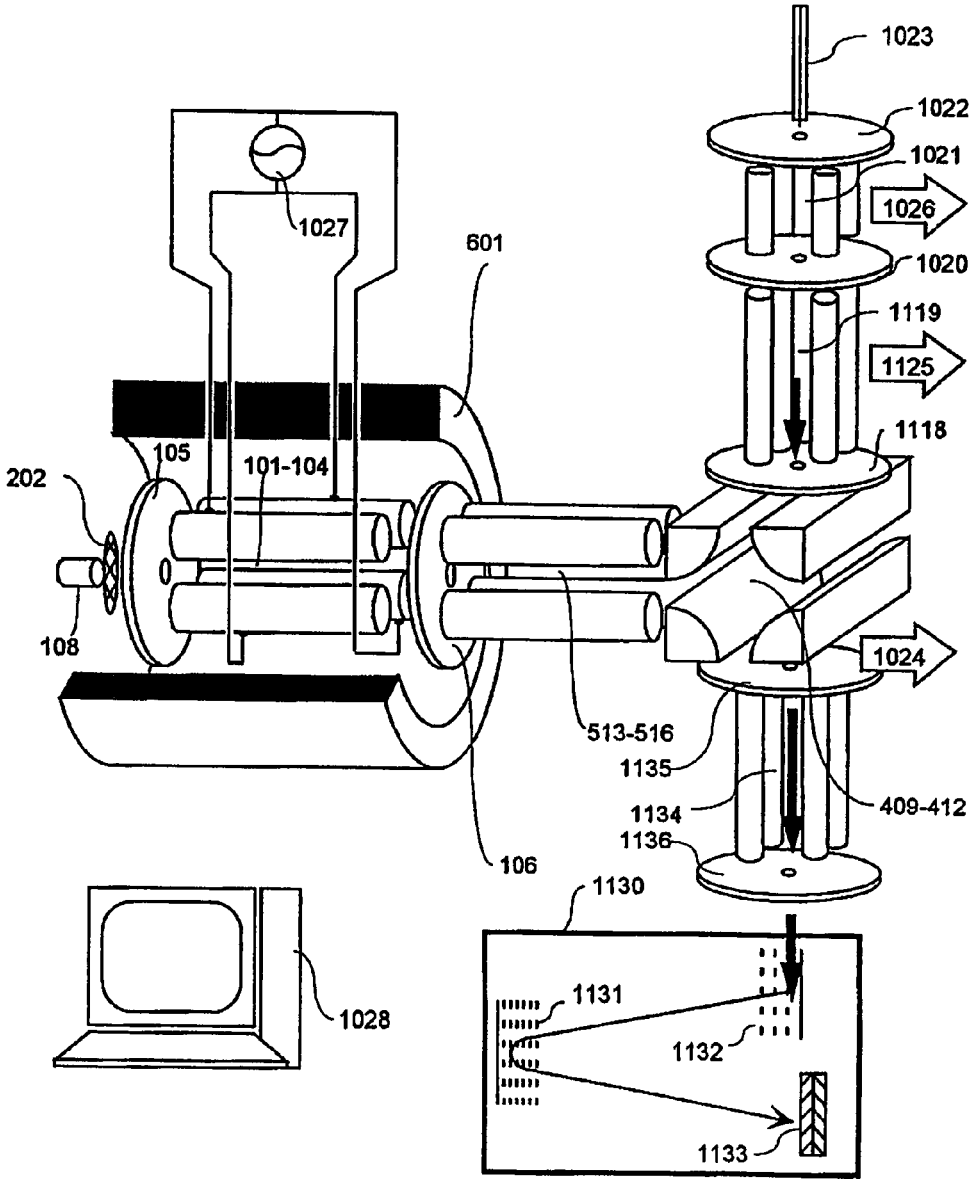
FIG. 12 is a schematic diagram to explain an example of still another mass spectrometer in which still another ECD cell provided with the magnetic field-generating unit using the permanent magnet is employed for ECD, and the linear ion trap mass analysis unit and the TOF mass analysis unit are provided.

FIG. 12 is a schematic diagram to explain an embodiment of a mass spectrometer provided with an ECD reaction unit with the use of an ECD cell provided with the magnetic field-generating unit using a permanent magnet, the linear ion trap mass analysis unit, and the TOF mass analysis unit. It is a feature that, in addition to the ECD reaction unit having a structure in which the permanent magnet is a magnetic field-generating means and the quadrupole deflector is provided, the ion source and the linear ion trap mass analysis unit are provided at one ion port of the quadrupole deflector and another mass analysis unit is provided at the other port. It is also a feature that a low-cost and simple analyzer structure is provided by employing the permanent magnet. Since control of the magnetic field is not possible, it is difficult to perform CID in the ECD reaction unit. However, it is possible to perform CID by the linear ion trap mass analysis unit. In other words, the structure of the mass spectrometer allows to perform either CID or ECD by selection.

The structural difference of this mass spectrometer from the second embodiment lies in that the permanent magnet is employed in place of the solenoid coil as the magnetic field-generating unit and that an AC power source is not provided because CID is not performed in the ECD reaction unit.

Figure 20:
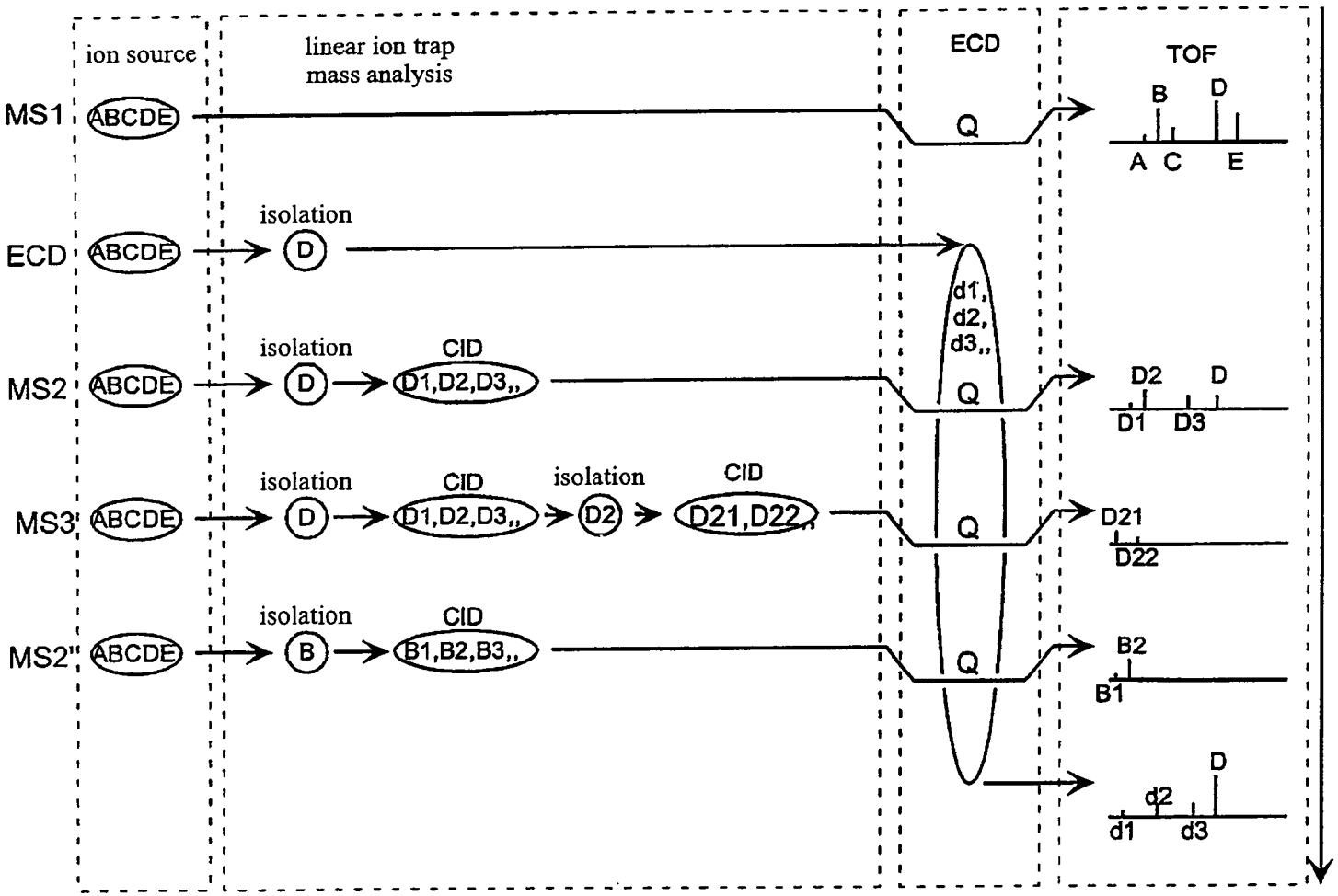
FIG. 20 is a schematic diagram to explain an operation example of the mass spectrometer in which the ECD cell provided with the quadrupole deflector and the magnetic field-generating unit using the permanent magnet is employed for ECD, and the linear ion trap mass analysis unit and the TOF mass analysis unit are provided.

FIG. 20 is a schematic diagram to explain a basic operation of the mass spectrometer provided with the ECD unit shown in FIG. 12. An MS mode that is an operation in which all ions contained in sample ions are mass analyzed, an ECD mode to perform ECD, a CID mode to perform CID, and an ECD+CID mode in combination of ECD and CID are explained.

Of the four dotted frames constituting each mode, the left dotted frame indicates the ion source, and an example containing five kinds of ions A, B, C, D, and E as ions produced by the ion source is shown. The dotted frame on the left of the center shows an operation of the linear ion trap mass analysis unit. The dotted frame on the right of the center shows an operation of the reaction part provided with ECD–CID function. The right dotted frame shows a schematic drawing of a mass spectrum obtained by mass analysis in the TOF mass analysis unit.

In the MS mode, a mass spectrum of sample ions is obtained. First, the ions produced by the ion source are trapped by the linear ion trap mass analysis unit. The trapped ions are directly injected into the TOF mass analysis unit and mass analyzed to obtain a spectrum of the sample ions. Referring to the mass spectrum obtained here, a parent ion species to be analyzed for sequence structure is selected.

A method to carry out the ECD mode is explained. In the ECD mode, a spectrum of ions dissociated by an ECD reaction of the isolated parent ions is obtained. A heater current is fed to the dispenser cathode all the time, keeping it in a heated state. The ions A, B, C, D, and E produced by the ion source are injected into the linear ion trap mass analysis unit and isolated. In the figure, the ion species D is isolated. The isolated ions are ejected to be introduced into the ECD–CID reaction unit, and ECD is carried out. When the static voltage of the electron source is set to a voltage higher than 0 V with respect to the linear quadrupole electrodes 101 to 104, the ions are injected into the ECD reaction unit. The injection of low energy electrons allows an ECD reaction to proceed, thereby producing ions d1, d2, and d3 dissociated by the ECD. The dissociated ions are ejected from the ECD–CID reaction unit, injected into the TOF mass analysis unit, and subjected to TOF mass analysis to obtain a spectrum of the dissociated ions.

A method to carry out the CID mode is explained. In the CID mode, a spectrum of ions dissociated by a CID reaction of the isolated parent ions is obtained. The ions A, B, C, D, and E produced by the ion source are injected into the linear ion trap mass analysis unit and isolated. In the figure, the ion species D is isolated. CID is performed for the isolated ions inside the linear ion trap mass analysis unit. In this state, an AC voltage having a frequency corresponding to the frequency of secular motion of the selected parent ion D of a known mass inside the linear ion trap electrodes 101 to 104 is applied using the AC power source 913. Alternatively, an amplitude of ion trap RF generated by the RF power source 1027 is set such that resonance vibration is generated by an AC voltage with a constant frequency. In this way, ions dissociated by CID, D1, D2, and D3, are produced. The dissociated ions are mass selectively ejected from the ECD–CID mass analysis unit and detected by the TOF mass analysis unit to obtain a mass spectrum.

A method to carry out the ECD–CID mode is explained. The aim of this mode is to perform dissociations of ions in a combined mode in which a dissociated ion species produced by ECD is subsequently subjected to CID. By this operation, it becomes possible to differentiate between leucine and isoleucine that are amino acid residues having identical mass or to identify a molecule involved in post-translational modification where CID is performed for an ion species that is dissociated by ECD and has a molecule originating from the post-translational modification to isolate and identify the molecule participating in the post-translational modification. In a manner similar to the ECD mode, dissociated ions are produced by ECD. Then, one dissociated ion species is isolated (d2 ion is schematically isolated in the figure), and CID is applied. During the period of the operation of this isolation and CID, application of the magnetic field is stopped. The ions dissociated by CID are injected into the TOF mass analysis unit and a mass spectrum is obtained by mass analysis.

In the present embodiment, since the permanent magnet is used without using an electromagnetic magnetic field-generating unit, a structural simplification is achieved in the respect that a power source to a coil and a cooling system for the coil are not required, which makes it possible to provide a low-cost analyzer. This structure is suitable for an analysis not targeted for an analysis of post-translational modification that requires a combination of ECD and CID, that is, a top-down analysis of protein structure.

Fourth Embodiment of Mass Spectrometer Provided with ECD Reaction Unit

Figure 16:
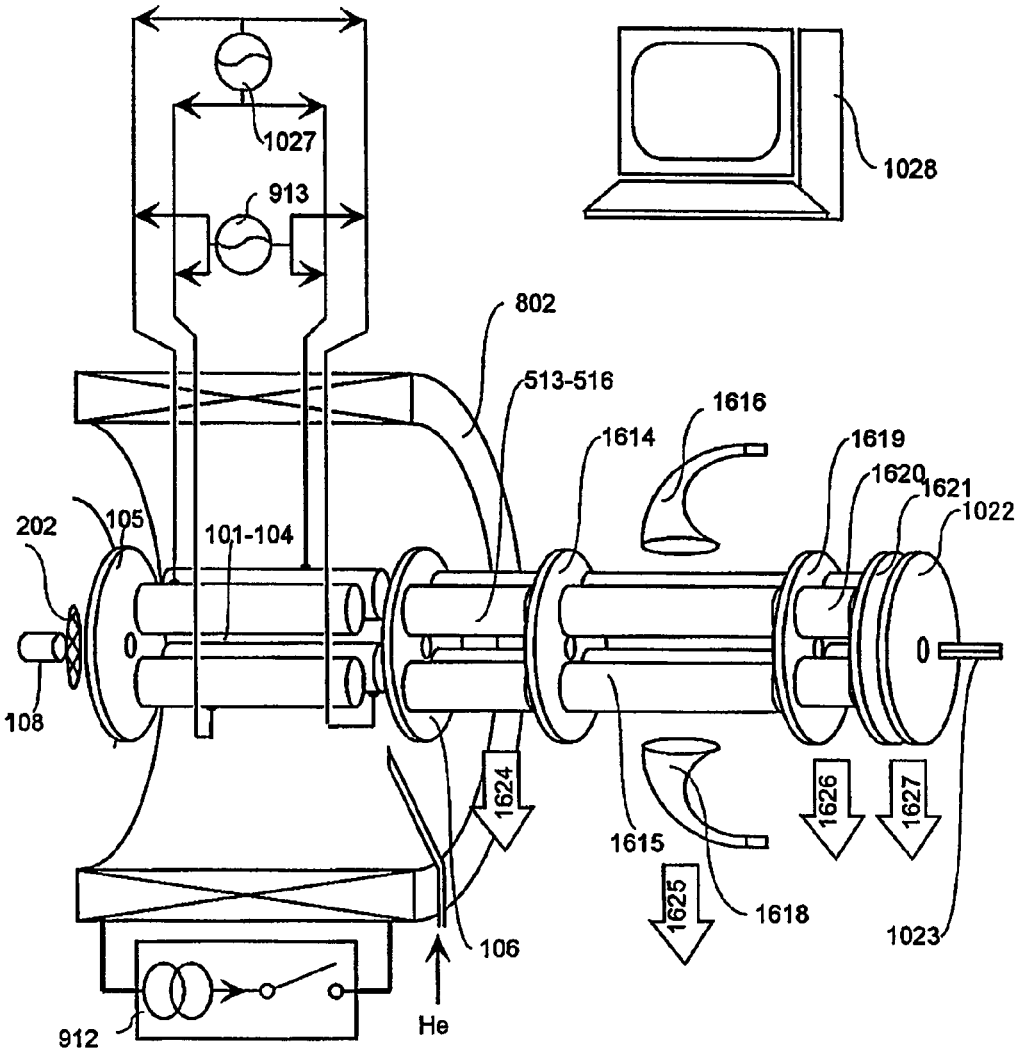
FIG. 16 is a schematic diagram to explain an example of still another mass spectrometer in which an ion source, a linear mass analysis unit, and the ECD cell are included.
Figure 17:
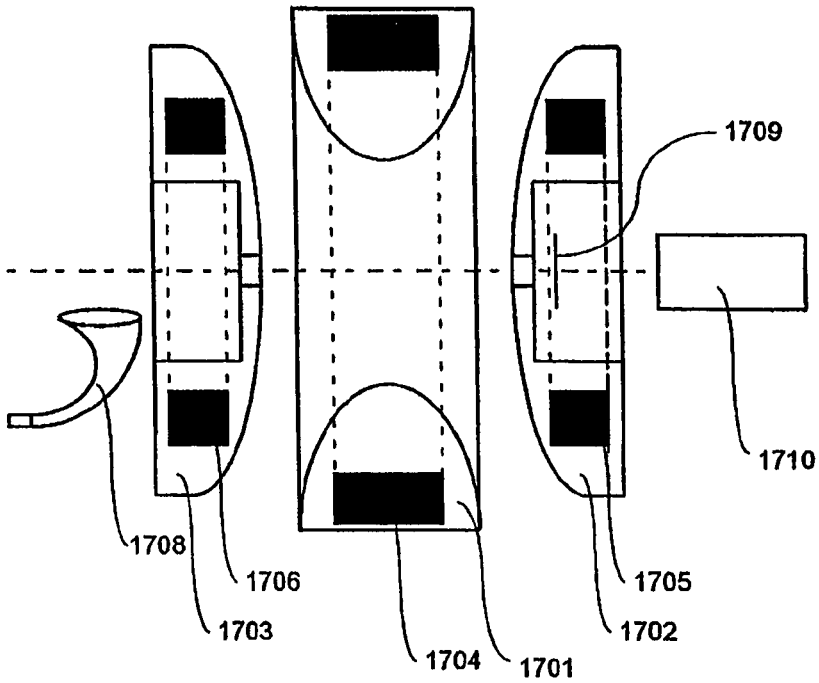
FIG. 17 Prior Art
FIG. 17 is a schematic diagram to explain a known example of a three-dimensional ion trap ECD mass spectrometer provided with a magnet.
Figure 18:
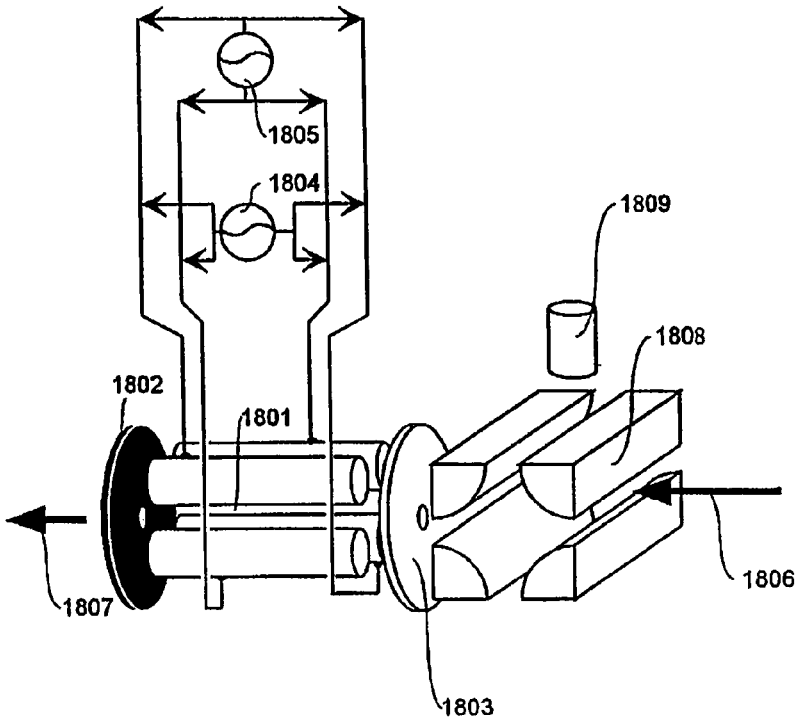
FIG. 18 Prior Art
FIG. 18 is a schematic diagram to explain another known example of a two-dimensional ion trap ECD mass spectrometer provided with a magnet.
Figure 19:
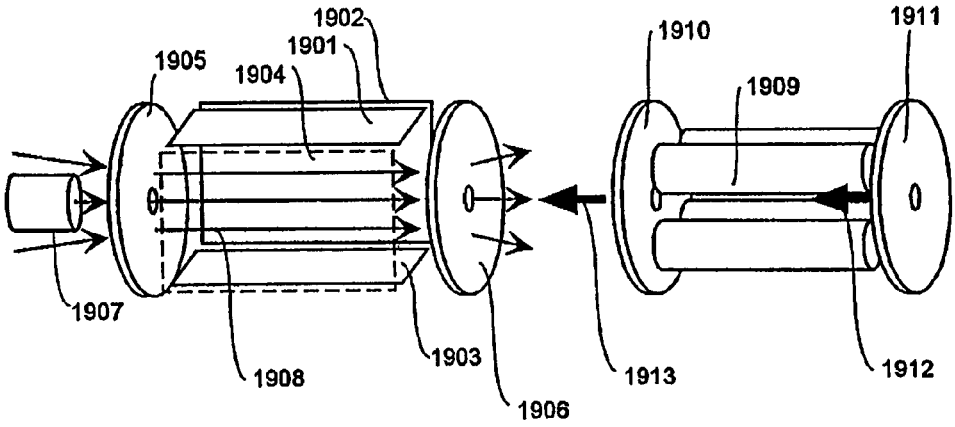
FIG. 19 Prior Art
FIG. 19 is a schematic diagram to explain a known example of ECD in a Fourier transform mass spectrometer.

FIG. 16 is a schematic diagram to explain an embodiment of a mass spectrometer including a linear mass analysis unit and the ECD cell. It is a feature that an ECD function having an analyzer structure in which an ion source, a linear ion trap mass analysis unit, and the ECD device according to claim 1 are arranged in tandem and ion guides are inserted between those components as needed is provided.

The structure of the analyzer is provided with the ESI ion source consisting of an ion source capillary 1623 and an interface electrode 1622 and an ion guide consisting of linear RF multipole electrodes 1620 and a pore electrode 1621. Ions produced by the above and introduced into vacuum are injected into the linear ion trap mass analysis unit (1614 to 1616, 1618, and 1619). The present mass analysis unit has a structure shown in Non-patent document 6. That is, the structure is based on the principle that ions subjected to resonance oscillation inside linear quadrupole electrodes are allowed to resonate and vibrate in the radial direction of the quadrupole electrodes, ejected, and detected by an ion detector 1616 and 1618. FIG. 16 is a simplified description based on the operational principle. In the present mass analysis unit, ion isolation, CID reaction, and mass analysis to obtain mass spectra are performed. To the linear ion trap unit, the ECD–CID reaction unit is connected via an ion guide 1613.

Basic operations of dissociation and mass analysis in the present example are shown. Sample ions produced by the ion source are injected into the linear ion trap mass analysis unit via the ion guide 1620. Here, a first mass analysis is performed to obtain a spectrum of ions contained in the sample ions. Referring to the obtained mass spectrum, an ion species to be subjected to analysis of sequence structure by a dissociation reaction is selected. The ions are again injected and the selected ion species is isolated by resonance vibration of ions using the linear ion trap mass analysis unit. When ECD is performed here, the isolated ions are injected into the ECD–CID unit and irradiated with electrons to cause an ECD reaction. The dissociated ions are ejected from the ECD–CID unit and again injected into the linear ion trap mass analysis unit. Here, mass analysis by resonance vibration is performed to obtain a mass spectrum. When mass analysis, isolation, and CID are carried out in the linear ion trap mass analysis unit, it is effective to stop a magnetic field of the ECD–CID unit in order to obtain mass resolution.

Note that it is easy to perform only CID as well as a combination of ECD and CID using the linear ion trap mass analysis unit of the present embodiment. The basic procedures are almost in accordance with the contents explained in FIG. 13. The only difference is that linear ion trap mass analysis is used for mass analysis in place of TOF mass analysis.

Figure 21:
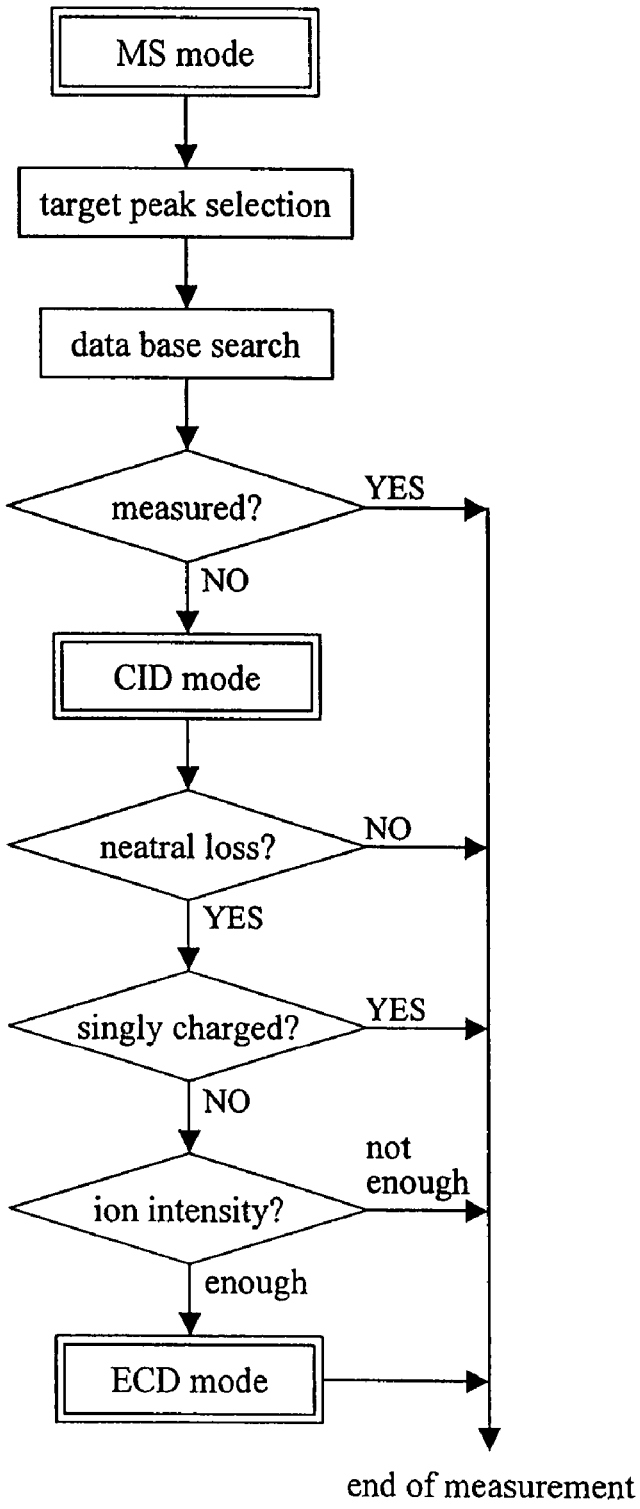
FIG. 21 is a flow chart to explain the measurement procedures to perform an analysis of post-translational modification using the apparatus of the present invention.

Embodiment of Analytical Procedures for Protein Modified with Phosphate Groups or Sugar Chains The procedures of structure analysis of post-translationally modified protein by mass spectrometry in which ECD and CID are combined are explained. The basic measurement sequence is shown in FIG. 21. In these procedures, first, a protein is judged for its post-translational modification with the use of CID, the size of the modified molecule is acquired, and subsequently the site of modification is identified with the use of ECD.

As shown in FIG. 21, the measurement is first initiated from a measurement of sample ions by the MS mode. From this measurement, the distribution of ions injected into a mass spectrometer as a sample is determined. Identification of ion species including sequence information is sometimes possible by referring to measured ion masses and retention times from liquid chromatography. In that case, it is unnecessary to identify ion species by a dissociation reaction any more. When the ion species have already been identified by referring to database for ion identification consisting of elution times and ion masses, the measurement is terminated. When not identified, the next procedure is undertaken.

Next, the CID mode is applied to a selected ion species. When the ion species is post-translationally modified, neutral loss occurs by CID. Neutral loss means that a part constituting a molecule is lost without change of valence before and after reaction. The site of post-translational modification is preferentially dissociated by CID, and thus, neutral loss tends to occur. In this neutral loss, when a mass corresponding to phosphate ($PO_4$) is lost, it can be judged that the protein is modified by phosphorylation. Further, when the loss can be explained by a combination of monosaccharide masses, it can be judged that the protein is modified by sugar chains. Generally, when neutral loss occurs at a high probability, the protein may simply be judged to be a molecule that is post-translationally modified. When neutral loss does not occur at a high probability, a CID spectrum can be obtained as usual, thereby terminating the measurement.

Subsequently, the ECD mode is applied to an ion species that was judged as neutral loss. ECD cleaves the main chain consisting of a sequence of amino acid residues while preserving the site post-translationally modified. Therefore, when the ECD spectrum is examined, a spacing of a large value between C and Z fragments that is associated with a molecule involved in post-translational modification is found in addition to C and Z fragments of a usual sequence of amino acid residues. The site that gave rise to this large spacing can be judged as the site of post-translational modification.

Fifth Embodiment of Mass Spectrometer Provided with ECD Reaction Unit

Figure 22:
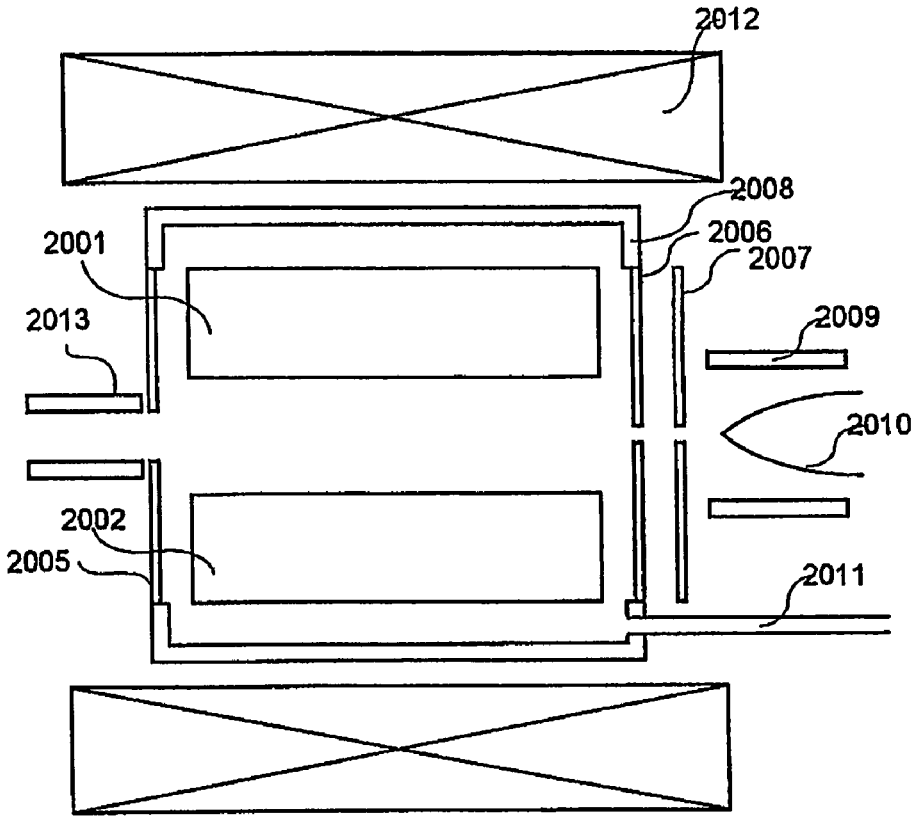
FIG. 22 is a schematic diagram to explain an ECD reaction unit using a filament as the electron source and provided with a gas cell.
Figure 24:
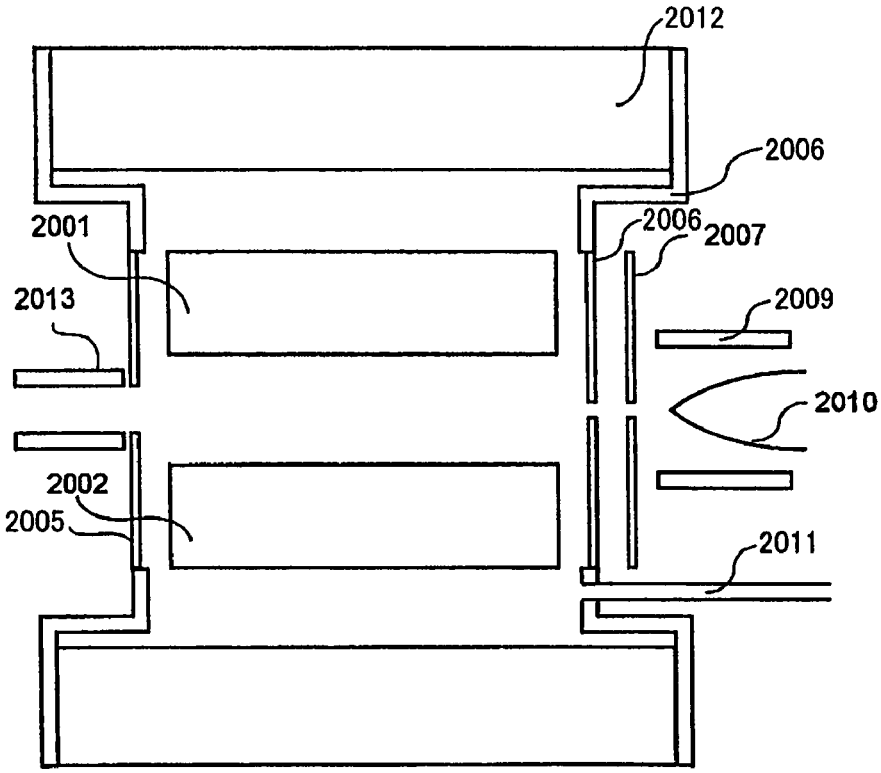
FIG. 24 is a schematic diagram to explain another ECD reaction unit using the filament as the electron source and provided with another gas cell.
Figure 25:
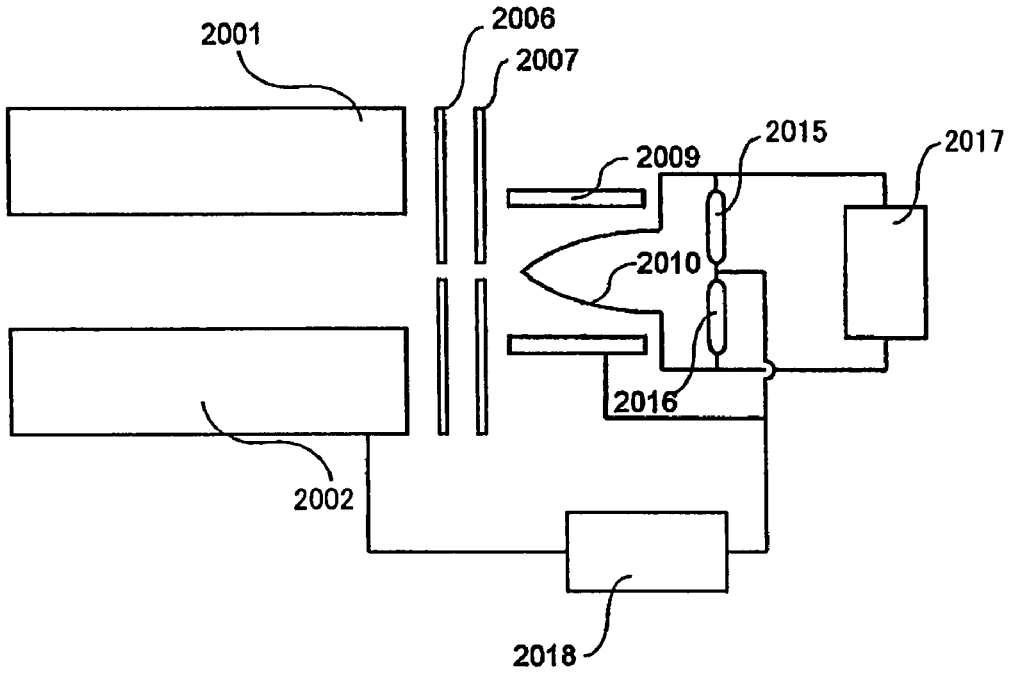
FIG. 25 is a schematic diagram to explain an example when the filament was used as an electron source.

FIGS. 22 and 24 represent examples of an embodiment of the ECD reaction unit provided with electrodes to monitor electron intensity and a gas chamber, and FIG. 25 is an embodiment of a mass spectrometer provided with a plurality of such ECD reaction units. In FIGS. 22 and 24, linear quadrupole electrodes shown by 2001 to 2004, a wall electrode shown by 2005, a wall electrode shown by 2006, an electron-drawing electrode, or a grid electrode, shown by 2007, a gas chamber shown by 2008, an electron source cover shown by 2009, a filament shown by 2010, a gas inlet pipe 2011, a cylindrical magnet shown by 2012, and a current monitoring electrode shown by 2013 are included.

Figure 23:
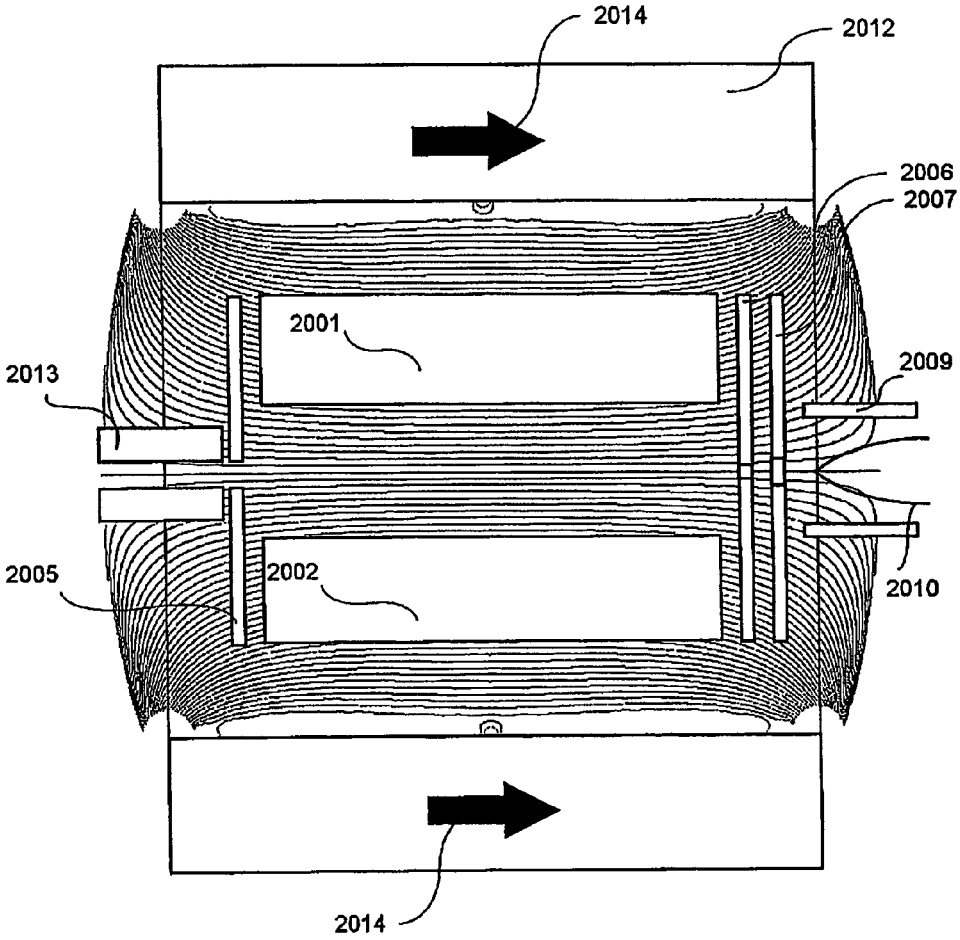
FIG. 23 is a schematic diagram to explain the lines of magnetic force in the inside of the cylindrical magnet and the electron source position.

For electron monitoring, monitoring of electron intensity and a function to monitor electron energy are required. For monitoring the electron energy, its detection in a region where RF is not applied is particularly effective. Therefore, the electron monitoring electrode 2013 is placed outside the wall electrode 2005. Electrons are allowed to pass through a hole on the wall electrode 2005 in order to efficiently guide the electrons to the electron monitoring electrode 2013. It becomes possible for the electrons to be efficiently passed through the hole as well as efficiently captured by the electron monitoring electrode 2013 by distributing a magnetic field as shown in FIG. 23. That is, the two wall electrodes 2005 and 2006 are placed at approximately symmetric positions with respect to the cylindrical magnet 2012 in the inside of the magnet. Further, the electron monitoring electrode 2013 is arranged so that the magnetic lines of force passing through the hole on the wall electrode 2005 as shown in FIG. 23 may penetrate. By this arrangement, electrons are efficiently captured by the electron monitoring electrode 2013.

Figure 27:
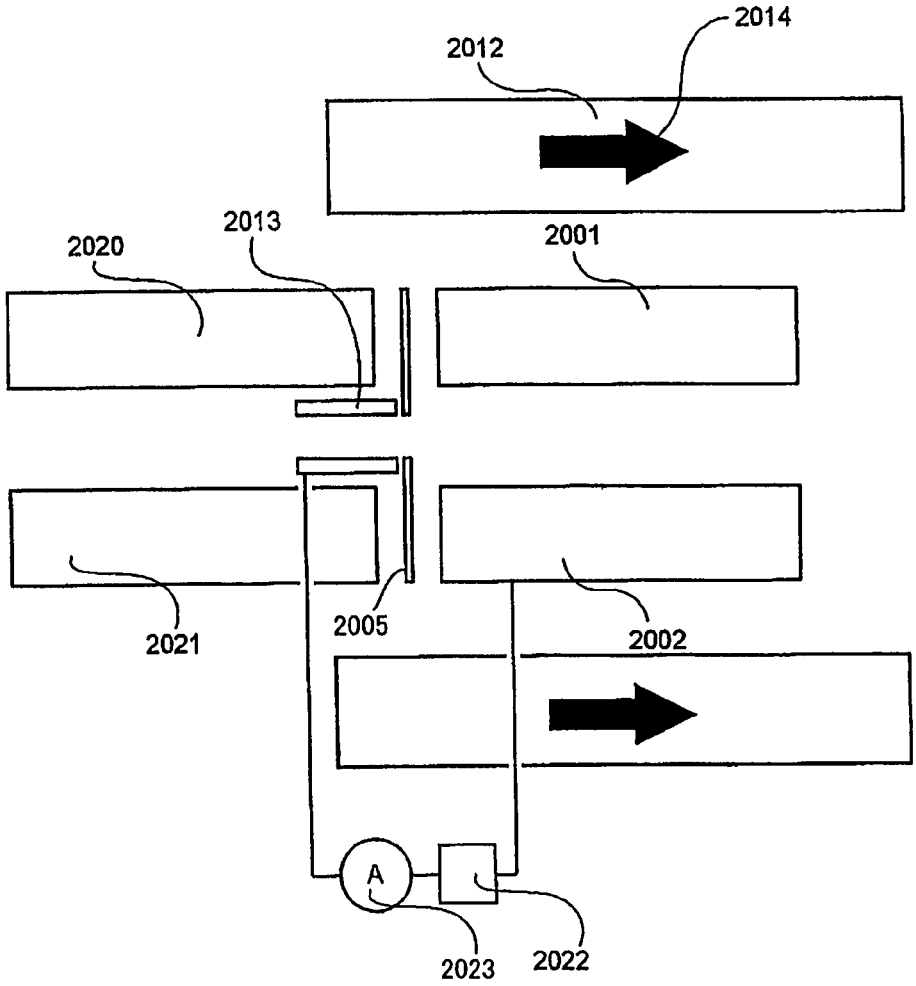
FIG. 27 is a schematic diagram to explain monitoring of electron intensity.

For monitoring the electron energy, a circuit shown in FIG. 27 is used, where the linear quadrupole electrodes shown by 2001 to 2004, the wall electrode shown by 2005, the cylindrical magnet shown by 2012, the current monitoring electrode shown by 2013, arrows shown by 2014 indicating the direction of magnetization of the magnet, ion guide electrodes shown by 2020 to 2023, a voltage source shown by 2022, and an ammeter shown by 2023 are included. A bias voltage is applied to the current monitoring electrode 2013, relative to the linear quadrupole electrodes 2001-2004, using the power source 2022. When the voltage value becomes higher than electron energy (indicated by eV unit), electrons becomes detectable as an electric current by the current monitoring electrode. Accordingly, the electron energy and its intensity are observed by changing the bias voltage and detecting the current value with the ammeter 2023. Since kinetic energy of electrons is an important parameter in ECD, it is effective to provide the mean for tuning of the device.

Figure 26:
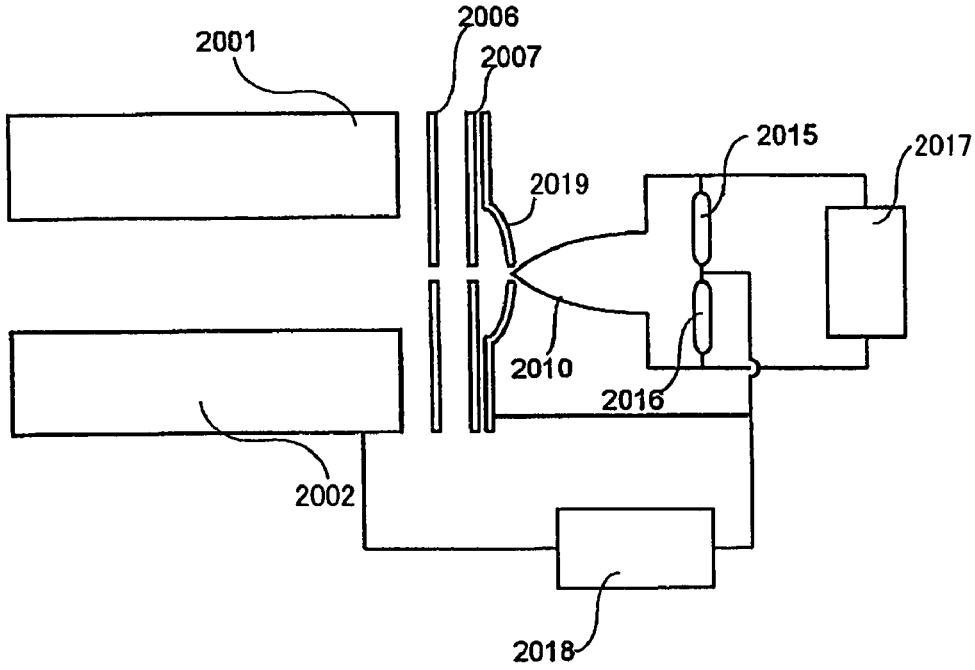
FIG. 26 is a schematic diagram to explain another example when the filament was used as the electron source.

In the present example, the electron source makes use of the filament 2010 made of tungsten. When the degree of vacuum in which the ECD cell is placed is a degree of vacuum worse than $10^{-6}$ Torr, the use of a dispenser cathode becomes difficult, and therefore, the use of the filament is effective. FIGS. 25 and 26 show the structure of the electron source part and a driving power source, which include the linear quadrupole electrodes shown by 2001 to 2004, the wall electrode shown by 2006, the electron-drawing electrode shown by 2007, the filament shown by 2010, resistors shown by 2015 and 2016, a current source shown by 2017, a voltage source shown by 2018, and an electron lens electrode shown by 2019.

The filament 2010 is heated by the current source 2017. The filament is provided with a crimp at its center portion. The temperature of this portion becomes high and electrons can be strongly generated from the tip of this filament. On the filament, a potential difference is generated by its electrical resistance along the longitudinal direction of the filament. When this structure is used, it becomes possible to make kinetic energies of electrons uniform because electrons are emitted from the chip. In order to control the potential at the center portion of the filament with the use of the power source 2018, the both ends of the filament are connected to the resistors 2015 and 2016, and a voltage is applied between both of them. In this way, the potential at the point of electron generation on the filament can be matched to the output voltage of the power source 2018.

Of the two embodiments in FIGS. 25 and 26, FIG. 25 represents an embodiment with a simpler structure, in which thermoelectrons generated by the filament 2010 are drawn out by the grid electrode 2007 and allowed to be introduced from the hole on the wall electrode 2006. In FIG. 26, the electron lens electrode 2019 is employed. This electrode has a shape that allows the magnetic lines of force to become approximately perpendicular to this electrode surface. Owing to this, electrons coming out from the hole on the lens electrode 2019 are accelerated in parallel with the magnetic field. By virtue of this, cyclotron motion of the electrons caused by the magnetic field is suppressed, thereby increasing transmittance of the electrons at the center portion of an ion trap.

It is desirable to form the grid electrode of rhenium, molybdenum, or an alloy of rhenium and molybdenum in order to avoid change of the surface caused by long-time electron irradiation. Alternatively, it is desirable to coat the surface with fine graphite particles and the like to avoid the change. The change of the surface of the electrode has a possibility of significantly lowering its electron-drawing effect by losing surface properties as a metal and forming an insulating film to which electrons are charged. Further the grid electrode may be in a plate structure with an opening or a mesh structure. Since in the plate structure with an opening, there is no disadvantage of losing electrons by colliding with meshes, an electron source having a high efficiency of electron generation can be formed with ease. Further, when the mesh structure is employed despite the disadvantage of losing electrons by colliding with meshes, the direction of electron drawing can be made approximately parallel to the magnetic lines of force, and therefore an electron source having a high efficiency of electron introduction can be constructed.

FIG. 24 represents an embodiment in which the cylindrical magnet 2012 is utilized as the wall surface for a means to form gas chamber. Since there is no need to provide a wall for the gas chamber to the inside of the cylindrical magnet when this structure is employed, it becomes possible to make the size of the cylindrical magnet smaller and reduce the size and cost of the device.

Figure 28:
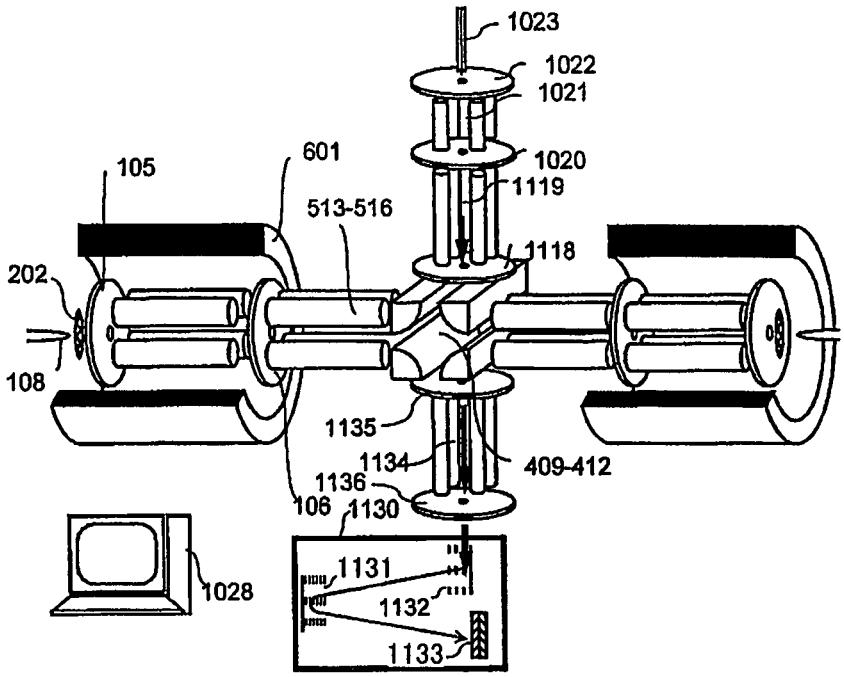
FIG. 28 is a schematic diagram to explain an embodiment provided with two reaction cells.

FIG. 28 is a diagram showing an embodiment of a mass spectrometer provided with a plurality of the ECD reaction units of the embodiment in FIG. 22 or 24. By providing a plurality of the reaction units, it becomes possible to speed up the reaction rate. The operation is almost the same as that of the embodiment explained in FIG. 12, the detailed explanation is referred to the above (the third embodiment of mass spectrometer provided with ECD reaction unit). It should be noted that the reaction unit arranged for the quadrupole deflector 409 to 412 is not limited to the ECD performing unit as in the case of the present example, and any mass analysis-related units such as an ion source, CID performing unit, electron transfer dissociation unit, and ion detector can be connected.

Sixth Embodiment of Mass spectrometer Provided with ECD Reaction Unit

Figure 29:
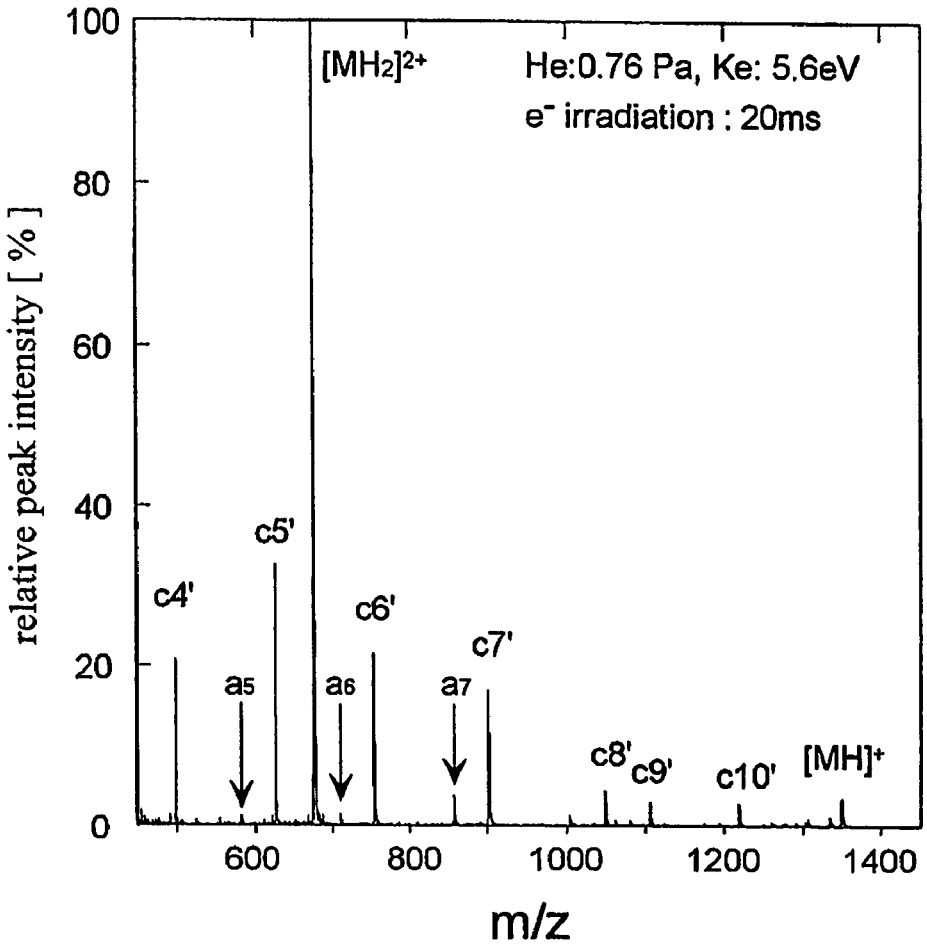
FIG. 29 represents an example of measurement of spectrum where ECD was made highly efficient by implementing the present invention and introducing a gas.
Figure 30:
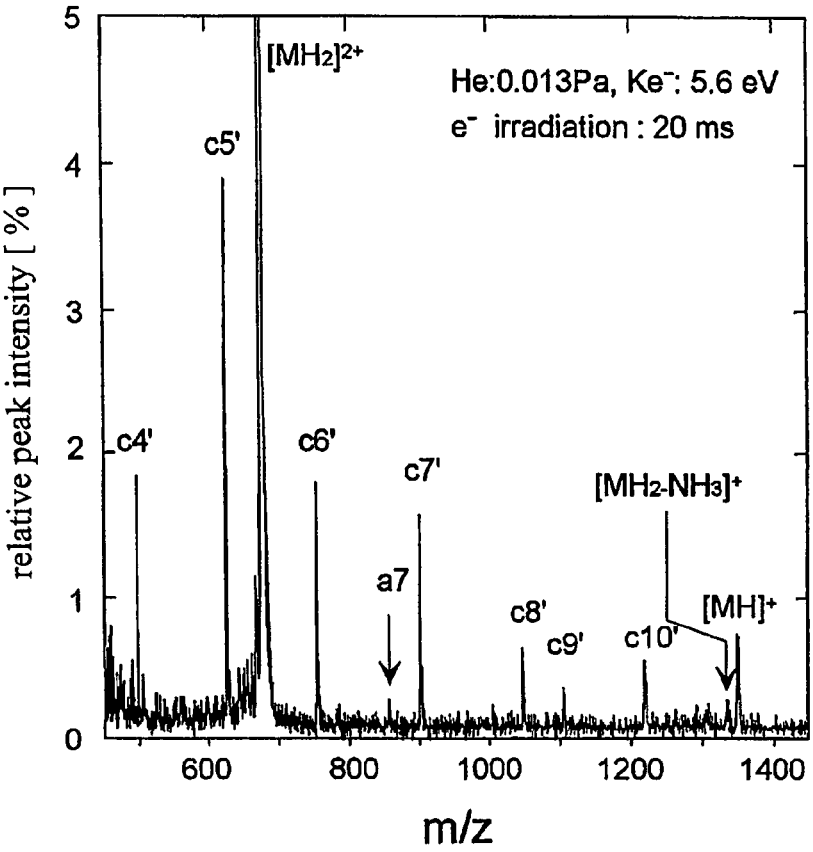
FIG. 30 represents an example of ECD spectrum by implementing the present invention under the condition without introduction of the gas.
Figure 31:
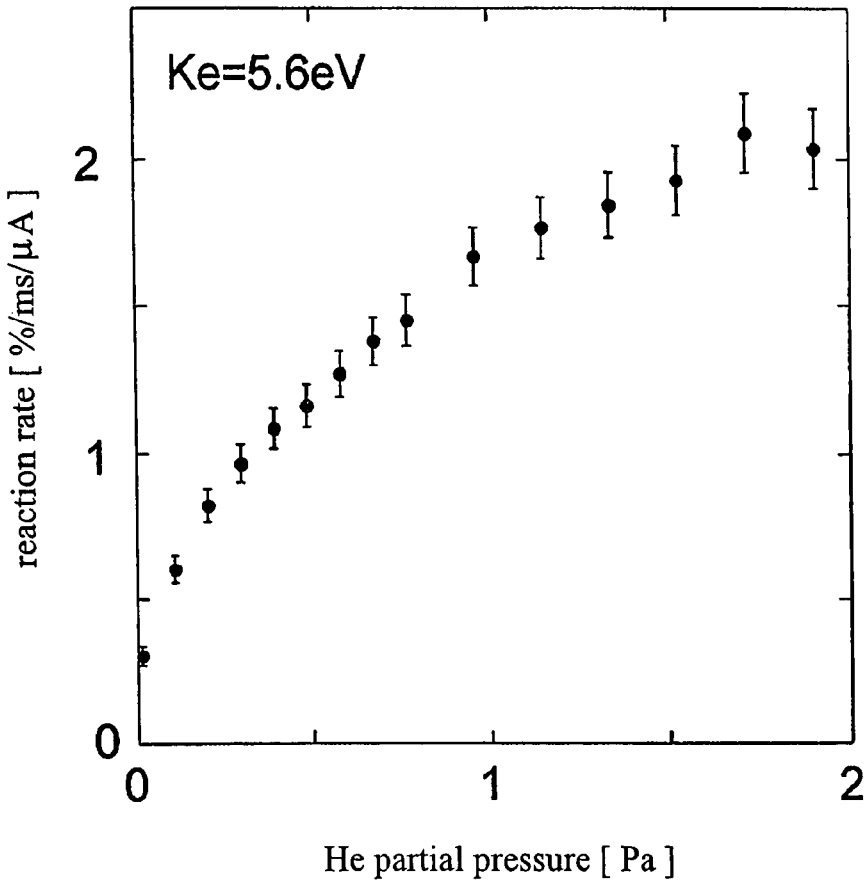
FIG. 31 is a graph showing results of enhancement effect of ECD rate dependent on introduction pressure of helium gas when implementing the present invention.

When a rare gas is introduced into a gas cell in an ECD reaction part, the reaction rate can be increased. The gas species for use in introduction into the gas cell is a rare gas such as helium, neon, and argon. At that time, the partial pressure of these gases in the inside of the gas cell is adjusted to 0.1 Pa to 10 Pa, and the irradiated electron energy is set to 2 eV to 10 eV. In this way, a high reaction rate can be obtained, and high speed ECD can be realized. FIG. 29 shows an example of measurement of ECD spectrum when substance P was introduced into the combined-type linear quadrupole RF ion trap of a structure of the present invention as a sample ion and helium gas was further introduced at a partial pressure of 0.76 Pa. The energy of irradiated electrons was 5.6 eV. The reaction time was 20 milliseconds, and sufficiently high-speed reaction was realized. An effect of significant improvements in reaction rate and signal to noise ratio that represent spectral quality is apparent compared with an example shown in FIG. 30 when the gas was not introduced. The dissociation rate can be enhanced by about one order of magnitude by introducing helium gas as shown in FIG. 31. This result indicates that introduction of the gas has a great effect on realizing implementation of ECD at high-speed that is sufficiently applicable to sequence analysis of large biomolecules The gas pressure is in a range of gas pressure that can not be realized in a conventional FT-ICR, which is a new finding in the RF ion trap. The effect of improvement in reaction rate by the gas introduction is not limited to a linear ion trap structure but can be implemented in a device structure to realize an ECD reaction that allows gas introduction such as an ion guide.

Figure 32:
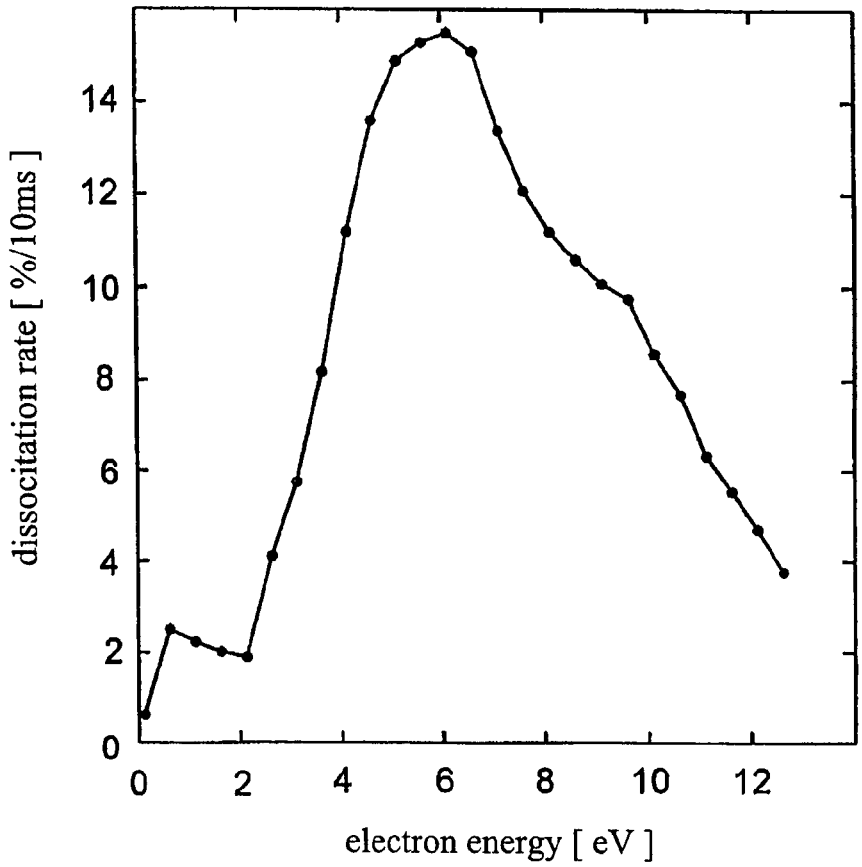
FIG. 32 is a graph showing results of the enhancement effect of ECD rate dependent on electron energy when implementing the present invention.

FIG. 32 shows the result of measurement of ECD reaction rate when electron energies were varied at a helium gas pressure of 0.47 Pa. The peak of the reaction rate observed at an electron energy below 2 eV represents ECD, and the distribution of the reaction rate observed at between 2 and 12 eV represents ECD reaction referred to as hot ECD. Particularly, a prominent reaction due to the gas was observed in hot ECD. ECD can be realized with high rate by utilizing this region, which is particularly effective in the field of proteome analysis in which proteins are analyzed at high-speed. Further, c and z fragments characteristic of ECD are formed in the region from 2 to 8 eV, while b and y fragments such as seen in a conventional high temperature ECD are not observed. When this energy region is utilized, a simple spectrum can be obtained, which is advantageous to data processing in proteome analysis with a large amount of data output.

What is claimed is:

1. A method comprising steps of:

introducing an ion to a linear ion trap having linear multipole electrodes applied with a radio frequency electric field, wall electrodes that are arranged on both ends in an axis direction of the linear multipole electrodes, and a cylindrical magnetic field-generating unit that generates a magnetic field containing the same axis as the axis of the linear multipole electrodes;

introducing an electron from an opposite side of the wall electrodes through which the ion is introduced;

dissociating the ion that is introduced in the linear ion trap;

ejecting the dissociated ion from the same side of the wall electrodes that the ion is introduced.

2. The method according to claim 1, wherein the electron is introduced by an electron source that is placed on or inside of an edge surface of the cylindrical magnetic field-generation unit.

3. The method according to claim 1, wherein an intensity of the magnetic field is set as not more than 1 mT.

4. The method according to claim 1, further comprising a step of introducing a rare gas into the linear ion trap.

5. The method according to claim 4, wherein the rare gas is set at 0.1 Pa to 10 Pa in the linear ion trap.

6. The method according to claim 1, wherein the energy of the electron is 0 eV to 13 eV.

7. A device comprising:

a linear ion trap having linear multipole electrodes applied with a radio frequency electric field;

a cylindrical magnetic field-generating unit that generates a magnetic field containing the same axis as the axis of the linear multipole electrodes and surrounds the linear ion trap;

an electron source that introduces electrons to the linear ion trap;

a gas supply unit that supplies gas into the linear ion trap;

a controller that switches on or off of electric supply to the cylindrical magnetic field-generating unit depending on executing a collision induced dissociation (CID) or electron capture dissociation (ECD) reaction.

8. The device according to claim 7, wherein the cylindrical magnetic field-generating unit is made of electromagnets or solenoids.

9. A method for analyzing ions comprising steps of:

introducing ions into a linear ion trap having linear multipole electrodes applied with a radio frequency electric field and a cylindrical magnetic field-generating unit that generates a magnetic field containing the same axis as the axis of the linear multipole electrodes;

isolating an ion of said ions;

dissociating said isolated ion by a collision induced dissociation (CID) or electron capture dissociation (ECD) reaction in the linear ion trap by controlling a switch of the magnetic field; and analyzing the dissociated ion.

10. The method for analyzing ions according to claim 9, wherein the ions are isolated in the linear ion trap.

11. The method for analyzing ions according to claim 9, wherein the magnetic field is switched off during the CID reaction.

12. An electron capture dissociation device comprising:

a linear ion trap having linear multipole electrodes applied with a radio frequency electric field, wall electrodes with a hole that are arranged on both ends in an axis direction of the linear multipole electrodes, and a cylindrical magnetic field-generating unit that generates a magnetic field containing the same axis as the axis of the linear multipole electrodes;

an electron source arranged opposite to the linear multipole electrodes with one of the wall electrodes sandwiched in-between to eject electrons generated from the electron source towards the linear multipole electrodes;

an electron monitoring electrode which detects at least one of an intensity and energy of an electron current and which is arranged opposite to the linear multipole electrodes with the other one of the wall electrodes sandwiched in-between.

13. The electron capture dissociation device according to claim 12, wherein the electron monitoring electrode is arranged so that magnetic lines passing through the hole of said wall electrode penetrate the electron monitoring electrode.

14. The electron capture dissociation device according to claim 12, wherein the electron source is filament with a current source for heating the filament to generate electrons.

15. The electron capture dissociation device according to claim 14, further comprising a grid electrode arranged between the filament and the wall electrode so that generated electrons are pulled out into the hole of the wall electrode.

* * * * *